United States Patent [19]

Tanaka

[11] Patent Number: 4,975,741

[45] Date of Patent: Dec. 4, 1990

[54] CONTROL UNIT FOR A COPYING MACHINE INCLUDING AUTOMATIC SHUTDOWN

[75] Inventor: Masaaki Tanaka, Kanagawa, Japan

[73] Assignee: Fuji Xerox Co., Ltd., Tokyo, Japan

[21] Appl. No.: 94,132

[22] Filed: Sep. 4, 1987

[30] Foreign Application Priority Data

| | | | |
|---|---|---|---|
| Sep. 11, 1986 | [JP] | Japan | 61-214601 |
| Sep. 11, 1986 | [JP] | Japan | 61-214602 |
| Sep. 11, 1986 | [JP] | Japan | 61-214603 |
| Sep. 11, 1986 | [JP] | Japan | 61-214604 |
| Sep. 11, 1986 | [JP] | Japan | 61-214605 |
| Sep. 11, 1986 | [JP] | Japan | 61-214606 |
| Sep. 11, 1986 | [JP] | Japan | 61-139483[U] |
| Sep. 11, 1986 | [JP] | Japan | 61-139484[U] |
| Sep. 11, 1986 | [JP] | Japan | 61-139485[U] |
| Sep. 11, 1986 | [JP] | Japan | 61-139486[U] |
| Sep. 11, 1986 | [JP] | Japan | 61-139487[U] |

[51] Int. Cl.[5] ..... G03G 21/00

[52] U.S. Cl. ..... 355/206; 355/208; 355/271

[58] Field of Search ..... 355/3 TR, 4, 14 R, 14 T R, 355/203, 204, 205, 206, 271, 272, 208

[56] References Cited

U.S. PATENT DOCUMENTS

| | | | |
|---|---|---|---|
| 3,620,616 | 11/1971 | Davidson et al. | 355/206 |
| 4,165,170 | 8/1979 | Donohue et al. | 355/271 X |
| 4,275,958 | 6/1981 | Tachika et al. | 355/4 X |
| 4,436,410 | 3/1984 | Komiya | 355/4 X |
| 4,769,673 | 9/1988 | Tomosada et al. | 355/206 |

*Primary Examiner*—Fred L. Braun

*Attorney, Agent, or Firm*—Finnegan, Henderson, Farabow, Garrett and Dunner

[57] ABSTRACT

A control unit of a copying machine, including an optical scanning mechanism for scanning a manuscript surface having a picture image; a photosensitive substance rotating synchronously with scanning of the optical scanning mechanism, on which an electrostatic latent image corresponding to the picture image is formed; developing apparatus for developing the electrostatic latent image; first reference signal generator for generating a first reference signal representing a rotational reference position of the photosensitive substance rotated synchronously with the rotation of the photosensitive substance; first controller for controlling a rotational position of the photosensitive substance according to the reference signal generated from the reference signal generator; transfer apparatus for transferring an image developed through the developing apparatus to a recording paper; second reference signal generator for generating a second reference signal representing a reference for forming an initiation position of the electrostatic latent image; third reference signal generator for generating a third reference signal representing a reference for a transfer initiation position sychronously with the transfer operation of the transfer apparatus; and timing signal generator for generating timing signals representing a grip timing for the recording paper synchronously with the transfer operation of the transfer apparatus.

5 Claims, 21 Drawing Sheets

CONTROL UNIT FOR A COPYING MACHINE INCLUDING AUTOMATIC SHUTDOWN

FIELD OF THE INVENTION

The present device, relates to a control unit of a copying machine that develops an electrostatic latent image after forming the electrostatic latent image on a photosensitive substance, and transfers said image onto a recording paper.

BACKGROUND OF THE INVENTION

As is generally known, a copying machine of this type records an image read out of a manuscript onto a recording paper by executing a series of processes such as:

(1) Photosensitivity is provided by charging a photosensitive substance.

(2) An electrostatic latent image is produced by exposing the electrostatic substance to an optical image.

3) The electrostatic latent image is developed with a toner.

(4) The developed image is transferred to a recording paper.

(5) The photosensitive substance is cleaned.

Furthermore, in a polychromatic copying machine, a polychromatic print that is the image of the manuscript is obtainable by means of color separation of the image of the manuscript, by repeatedly performing a series of processes of charging, exposure, development, transfer and cleaning as described above for every color separated image, and by forming by superposition the images in respective separated colors on the same recording paper.

In such a monochromatic or polychromatic copying machine, in order to have both the positional relationship between the manuscript picture image and the copied picture image, the positional relationship between respective colors coincide with each other, it is required to have the picture image scanning initiation timing of the optical scanning mechanism, which moves along the manuscript picture image surface. In other words the position where forming of the electrostatic latent image on the photosensitive substance is initiated and the position where transfer is initiated on the recording paper coincide exactly.

Therefore, in the copying machine of this type, it is required for a light source, a movable mirror, a photosensitive drum and a transfer drum, etc. to be driven exactly according to a predetermined timing so as to form the picture image. Accordingly, a control unit for controlling these positional relationship under the driving state is provided.

FIG. 24 is a schematic block diagram showing the structure of a conventional polychromatic copying machine. In the Figure, a manuscript table 102 is mounted on the upper surface of a main body 101, and a scan unit 103 is provided below this manuscript table 102. The scan unit 103 consists of a lamp 104, first and second mirrors 105 and 106, a filter lens unit 107, third and fourth mirrors 108 and 109, and so forth. The lamp 104 and the first mirror 105 are integrated :n a body so as to be movable in the directions A and B shown in the drawing. Furthermore, the second mirror 106 is constructed so as to move, according to the movement of the lamp 104 and the first mirror 105, at ½ of the speed of the movement.

In the copying operation, when the lamp 104 and the first mirror 105 are moved first in the direction shown with an arrow mark A, an optical image is irradiated onto the surface of a photosensitive drum 111, which is rotated clockwise. In this case, the filter lens unit 107 has been changed over so as to transmit the light having a color other than yellow color, and further, the photosensitive drum 111 has been charged by a charger 112. Therefore, said optical image becomes an electrostatic latent image corresponding to yellow color in the manuscript on the surface of the photosensitive drum 111. Then, yellow toner is deposited on this electrostatic latent image by means of a developing part 113. As a result, a toner image in yellow color is formed on the photosensitive drum 111.

On the other hand, the blank form fed from a blank form cassette 114 is wound a round a transfer drum 115, which rotates counterclockwise, and conveyed between the photosensitive drum 111 and a transfer drum 115. As a result, the abovementioned yellow toner image is transferred onto the blank form on the transfer drum 115. Then, the surface of the photosensitive drum 111 is cleaned in consecutive order by means of a cleaning unit 116 from the portion where transfer has been completed.

After the transfer of the yellow toner image is completed as described above, the filter lens unit 107 is changed over in the next place so as to transmit any color other than magenta color, and a developing part 117 for magenta color is selected at the same time, followed by the similar transfer operation as described above. Thereafter, the filter lens unit 107 is changed over so as to transmit any color other than cyanogen color, and a developing part 118 for cyanogen color is selected at the same time, thus performing similar transfer operation as described above. Then, when the transfer of three primary colors is completed, a composite image in yellow, magenta, and cyanogen colors is formed on the surface of the blank form on the transfer drum 115. Next the blank form on the transfer drum 115 is conveyed to a fixing unit 122 with a belt 121, and the color image formed on the blank form surface by means of this fixing unit 122 is securely fixed onto the blank form. Then, the blank form completed with fixing is ejected to a tray 123, thus completing a series of color copying operation.

FIG. 25 is a perspective view showing the outline of a position control mechanism of each movable part in the copying machine described above. The reference numeral 131 shown in the drawing is a chain with which the driving force of a motor (not shown) transmitted. Chain 131 is engaged with a sprocket 133. Reference numeral 132 denotes a shaft on which the sprocket 133 and a gear 134 are mounted with a common shaft center, and 135 reference numeral denotes a shaft on which the transfer drum 115 and a gear 136 are mounted. In abovementioned structure, when the sprocket 133 is rotated, the gear 134 and the photosensitive drum 111 are also rotated, and the gear 136 engaged with the gear 134 is rotated at the same time, which causes the shaft 135 to be rotated. With this, the transfer drum 115 is rotated. In this case, the pitch diameters of gears 134 and 136 are made to be the same. As the result, the photosensitive drum 111 and the transfer drum 115 rotate in reverse directions, at the same speed and synchronously with each other. Furthermore, on the transfer drum 115, the position of winding round the blank form is always controlled fixed by means of pawls 137 for controlling the position to wind round the blank form.

On the other hand, a pulley 142 is supported by the shaft through a bearing 141, and a movable pawl (not shown), which is driven by a solenoid, etc, is provided on the side of the pulley 142. When this pawl is driven and engaged with a pin 143 provided on the sprocket 133, the rotation of the shaft 132 is conveyed to the pulley 142, thereby to rotate the pulley 142 synchronously with the photosensitive drum 111 keeping a predetermined relationship with same. Then, the rotation of the pulley 142 is conveyed to a pulley 148 through a wire 144, and the rotation of this pulley 148 is conveyed to the scan unit 103 through shaft, pulley and wire, etc. As the result, when the pulley 142 is rotated, the lamp 104, etc. are moved in the direction shown by the arrow mark A corresponding to the rotation of the photosensitive drum 111. If the driving pawl slips off the pin 143, the 104, etc. are returned in the direction shown by the arrow mark B by means of the energizing force of a spring not shown.

According to abovementioned structure, since the scan unit 103 and the photosensitive drum 111 are mechanically interlocked with each other, the position of the electrostatic latent image formed on the photosensitive drum 111 becomes fixed. Moreover, since the photosensitive drum 111 and the transfer drum 115 rotate synchronously and in reverse directions with each other, and the position of winding the blank form a round the transfer drum 115 is fixed, positions of images in each color transferred on the blank form coincide with one another. As the result, color copying by process color printing is performed without causing color shear.

However, once a shear of positions of images in each color transferred onto the blank form occurs, color shear happens, resulting in an imperfect finished result, Accordingly, it is necessary to control very exactly the driving position relationship among the scan unit 103, the photosensitive drum 111, and the transfer drum 115.

In the abovesaid control unit, however, the whole interlocking of movable parts is performed mechanically. Therefore, it may happen sometimes that initial positions of each part of movable parts are varied by secular change, etc. As the result, there has been such a problem that the position of forming the electrostatic latent image is shifted, causing color shear to happen.

In order to prevent such color shear, etc., a unit has been proposed, wherein driving motors are provided for the scan part provided movably on a predetermined straight line track, wherein the rotating photosensitive drum keeps a predetermined relationship with the movement of this scan part, and wherein the rotating transfer drum keeps a predetermined relationship with this photosensitive drum, respectively, and wherein the structure is constituted in such a way that said photosensitive drum and said transfer drum are driven individually by means of abovementioned driving motors. Pulse encoders are provided for detecting rotational quantity of each of the abovementioned driving motors to control each of said driving motors individually based on the output of this pulse encoder.

According to such a unit, since color shear can be securely prevented from occurring and since the scan part, the photosensitive drum, and the transfer drum are interlocked with an electrical timing, such a unit has the following advantages: (1) no secular change occurs in point of the positional relationship, (2) reduced/enlarged copies of manuscripts are easily made available without requiring complicated mechanical mechanism, and (3) improvement of the copying efficiency may be aimed at by adopting a short scan, etc.

In abovementioned structure, the optical scanning mechanism is returned to the stop position by means of the energizing force of a spring, but some units are constructed in such a way that a counter that outputs the present position signal of the optical scanning mechanism by means of up-count and down-count of a rotation pulse synchronizing with the moving speed of the optical scanning mechanism is provided, and the optical scanning mechanism is made to move to the operation terminating position by the present position signal shown with the output of said counter, and is returned to the stop position thereof thereafter.

However, problems have occurred when the counter output is smaller than when said counter is in suspension at a specified stop position due to noise, etc. when the optical scanning mechanism is returned to the stop position thereof, such a state is produced that a motor as the motive power source is still controlled under accelerated condition even after the optical scanning mechanism passes the specified stop position and has reached the position of the stopper, and troubles such as burning of motor windings and driving circuits thereof are induced, thereby making the maintenance operation thereof very difficult.

Further, in a conventional structure as described above, acceleration/deceleration control of the rotation of the transfer drum is performed so that the point of the transfer paper and the electrostatic latent image forming initiation point can be made to coincide with each other by performing acceleration/deceleration control of the transfer drum. Therefore, if an abnormal matter occurs in a rotary encoder employed for the purpose of controlling the grip timing of the transfer paper, the transfer initiating point and the latent image forming initiation point slip off and the positional relationship with the manuscript picture image is dislocated. In particular, since the electrostatic latent images are formed three times in total in a polychromatic copying machine, a copied picture image faithful to the manuscript picture image is not available because of color shear. Moreover, the motor, which is the power source for the photosensitive subject, is caused to accelerate condition even when the end timing of the transfer cycle is reached. Therefore, troubles such as burning of motor windings or driving circuits thereof are generated, making the maintenance operation very difficult thereafter Still further, there is such a problem that, when it is arranged that the movable optical system, the photosensitive substance, and so forth, are controlled by independent servo loops, respectively, if an abnormal matter occurs in any of those servo loops, diagnosis becomes difficult because each of servo loops is not connected in a mechanical relationship.

Still further, in the structure described above, the movable optical system, which scans the manuscript picture image, the photosensitive substance, and the transfer drum are driven independently by means of individual servo loops. For example, for the transfer drum, there are provided a rotary encoder that generates a pulse signal synchronizing with the rotation of the transfer drum, and a preset counter that rotates the transfer drum in accordance with the difference between a pulse train corresponding to the target value cf the rotation quantity of the transfer drum. The pulse signal are provided in the servo loop, thereby to rotate the transfer drum until the count value of the preset counter becomes zero.

However, a gripper for gripping the transfer paper is mounted on the circumferential surface of the transfer drum. Additionally, a release cam, which peels off the transfer paper that is completed with transfer, is arranged as it were seeing the circumferential surface. Therefore, if the gripper and the release cam engage each another, or the gripper engages with other protruded part of the frame because of some causes, the rotation of the transfer drum presents locked condition. Then, since the pulse signal, which is synchronous with the rotation, will no longer be output, causing problems such as the counter value of the present counter is not reduced and, the applied voltage of the motor, which is the motive power source of the transfer drum, continues to be under accelerated condition. Furthermore, troubles such as burning of windings and driving circuits thereof are caused.

Still further, the abovementioned configuration, it has been arranged in such a way that the positional error of the gripper is detected at the scan initiation timing of the picture image, and acceleration/deceleration control of the transfer drum is executed immediately based on said positional error. As the result, misgripping occurs when the rotation speed of the transfer drum is varied immediately before the gripping operation of the transfer paper.

Still further, in the abovementioned configuration, there have been such problems that, when an abnormal matter has occurred in the signal path of the pulse encoder or a noise is mixed in, the interlocking relationship between the photosensitive drum and the scan unit or the interlocking relationship between the photosensitive drum and the transfer drum collapses, the forming initiation position of the electrostatic latent image becomes unstable, the positional relationship with the manuscript picture image is shifted, a specific color is missing and a copied picture image faithful to the manuscript picture image becomes unobtainable particularly in a polychromatic copying machine wherein, electrostatic latent images are formed three time. Moreover, the motor, which is the motive power source of the photosensitive substance, continues to be accelerated even at the termination timing of the transfer cycle, thus causing troubles such as burning of motor windings and driving circuits thereof and making the maintenance operation very difficult thereafter.

Still further, in the abovementioned configuration, the photosensitive substance is started in such a way that the time is measured with the start initiation timing of the optical scanning mechanism as the initiation point, and the electrostatic latent image in the next color is formed by starting the optical scanning mechanism again when the measured time reaches the copy initiation time for that next color.

In this case, however, the synchronous relationship between the optical scanning mechanism and the photosensitive substance is dislocated in every copy cycle for respective colors by means of nonuniformity of the rotation period of the photosensitive substance. Such dislocation is accumulated and causes even bigger nonuniformity in shade for each color.

Still further, in the configuration described above, acceleration/deceleration control of the transfer drum is performed so that the transfer initiation point and the latent image forming initiation point may coincide with each other with the grip timing signal of the transfer paper which is output synchronously with the rotation of the drum as the reference.

In fact, the accuracy of a sensor which generates said timing signal is low, and further, usually a l:m gear intervenes between the motor as the motive power source and the transfer drum. As a result, the transfer initiation point and the latent image forming initiation point slip off from each other.

On the circumferential surface of the transfer drum, a plastic net is formed in the length corresponding to the maximum length of the transfer paper so as to attract the transfer paper with static electricity. If the picture image forming area of the photosensitive drum stops at the portion of this plastic net, abnormal transfer, viz., so-called deletion is generated at the time of transfer. Therefore, it is required to perform control to stop the photosensitive drum and the transfer drum so that the electrostatic latent image forming area of the photosensitive drum and the plastic net do not accord with each other. Besides, such a relationship must also be returned to the normal positional relationship after the relationship between both is shifted due to paper jam.

However, the starting positional relationship between the photosensitive substance and the transfer drum have been heretofore adjusted by a Control Enable signal only when an abnormal matter such as a paper jam occurred. Accordingly, that the positional relationship between the photosensitive substance and the transfer drum is left as is, even if said relationship is shifted for some reason until an abnormal matter occurs, thus lowering the picture quality.

Still further, the control for returning the optical scanning mechanism to the stop position thereof has heretofore depended on the energizing force of a spring only. Therefore, the stop position of the optical scanning mechanism is shifted in every copy cycle due to the state variation of a motive power conveying mechanism, etc., which makes the running time of the optical scanning mechanism different when copying is initiated again. Thus, the positional relationship between the manuscript picture image and the copied picture image or the positional relationship between respective colors no longer coincides, causing such problems as color shear in a polychromatic copying machine and a deterioration of picture of quality.

Still further, in the abovementioned configuration, the rotation of the photosensitive substance, the transfer drum, and so forth is controlled based on the pulse signals from a pulse generator (a rotary encoder) mounted on the rotation shaft of each rotating body.

However, there have been problems that, when some abnormal matters occur in the pulse generator or the signal path thereof, the motor, which is the motive power source of the photosensitive substance, is accelerated even after the termination timing of the copying cycle is reached, causing troubles such as burning of motor windings and driving circuits thereof and making the maintenance operation very difficult thereafter.

SUMMARY OF THE INVENTION

Accordingly, it is an object of the device to eliminate the above-described difficulties accompanying a conventional control unit of copying machines.

Another object of the present device is to provide a control unit of a copying machine that produces a copied picture image faithful to a manuscript picture image.

A further object of the present device is to provide a control unit of a copying machine that is able to prevent troubles, such as burning of the motor, from occurring.

A still further object of the present device is to provide a control unit for a copying machine that is able to stop the copying operation thereafter when an abnormal matter has occurred in the signal path for position control, and to prevent troubles, such as burning of a motor, from occurring.

A still further object of the present device is to provide a control unit of a copying machine that is able to keep the starting positional relationship between the photosensitive substance and the transfer drum always under a normal relationship.

A still further object of the present device is to provide a control unit of a copying machine that is able to have the latent image forming initiation point and the transfer initiation point coincide with each other with high accuracy.

A still further object of the present device is to provide a control unit of a copying machine that is able to keep the synchronous relationship of the start timing between the photosensitive substance and the optical scanning mechanism fixed at all times.

A still further object of the present device is to provide a control unit of a copying machine that is able to obtain good picture quality having no color shear or positional dislocation.

A still further object of the present device is to provide a control unit of a copying machine that is able to perform acceleration/deceleration control of the transfer drum without causing misgripping.

A still further object of the present device is to provide a control unit of a copying machine that can easily diagnose abnormality existing in the means for controlling each portion of the copying machine.

According to the present device, a control unit of a copying machine provided with an optical scanning mechanism for scanning a manuscript picture image surface, a photosensitive substance rotating synchronously with the scanning of said optical scanning mechanism and on which an electrostatic latent image corresponding to said manuscript picture image is formed, developing means for developing said electrostatic latent image, reference signal generating means for generating a reference signal showing a rotational reference position of said photosensitive substance synchronously with the rotation of said photosensitive substance, and means for controlling the rotational position of said photosensitive substance based on the reference signal generated from said reference signal generating means, is characterized by including: measuring means for measuring a time interval of the reference signal generated from said reference signal generating means, and control means for discriminating whether the measured time interval falls within a specified range or not, and for stopping the copying operation if said time interval is out of the specified range.

In the present device, the time interval of the reference signal is always measured, and if it is judged that an abnormal matter has occurred i.e. when the measured value is out of a specified range, the copying operation is halted thereafter.

According to the present device, there are provided switching means that is disposed at a predetermined distance from the stop position of the optical scanning mechanism toward the scanning direction of the manuscript picture image and is operated every time said optical scanning mechanism reciprocates for the purpose of scanning for reading the manuscript picture image, reference signal generating means that is coupled with the rotation shaft of a motor for driving said optical scanning mechanism and generates a reference signal between the operating position of said switching means and said stop position, pulse generating means that is coupled with the rotation shaft of the motor for driving said optical scanning mechanism, and generates pulses at every predetermined rotation angle, measuring means for measuring the time interval from the operation timing of said switching means to the generation timing of said reference signal by counting said pulses, and control means for executing emergency shut down of the copying operation when a measured value of said measuring means does not fall within a predetermined range at the starting time of said optical scanning mechanism.

When the optical scanning mechanism is returned to the stop position thereof, the distance from the operation timing of the switching means to the stop position of the optical scanning mechanism is measured by the measuring means. Then, this measured value is compared with a predetermined value at the time when a new copying cycle is initiated. If the measured value does not fall within a predetermined range, then emergence of the copying operation is executed on the theory that an abnormal condition has occurred.

According to the present invention, there are provided switching means disposed at a predetermined distance from the stop position of the optical scanning mechanism toward the scanning direction of the manuscript picture image, and is operated every time said optical scanning mechanism reciprocates for the purpose of scanning for reading the manuscript picture image, reference signal generating means that is coupled with the rotation shaft of a motor for driving said optical scanning mechanism, and generates a reference signal between the operating position of said switching means and said stop position, pulse generating means that is coupled with the rotation shaft of the motor for driving said optical scanning mechanism, and generates pulses at every predetermined rotation angle, measuring means for measuring the time interval from the operation timing of said switching means to the generation timing of said reference signal by counting said pulses, and control means for controlling the stop position of said optical scanning mechanism based on the measured value of said measuring means.

When the optical scanning mechanism is returned to the stop position thereof, the time interval from the operation timing of the switching means to the generation timing of the reference signal is measured by the measuring means, and the optical scanning mechanism is controlled so as to stop at the specified position in accordance with the measured value.

According to the present invention, there are provided reference signal generating means for generating a reference signal which is employed as the reference for the transfer initiating position of an electrostatic latent image synchronously with the rotation of the transfer means, pulse generating means for generating pulse signals corresponding to the grip timing of the transfer paper synchronously with the rotation of said transfer means, measuring means for measuring the synchronous relationship between said reference signal and said pulse signal and the time interval of said reference signal, and control means which discriminate whether the measured synchronous relationship and time interval fall within the specified range or not, and stops copying operation which they are out of the specified range.

When the synchronous relationship between the grip timing signal and the reference signal no longer have the specified relationship with each other, or when the generating interval of the reference signal is no longer kept at the specified interval, control means stop the copying operation thereafter.

According to the present invention, a control unit of a copying machine is provided with an optical scanning mechanism for scanning a manuscript picture image surface, a photosensitive substance rotating synchronously with the scanning of said optical scanning mechanism and on which an electrostatic latent image corresponding to said manuscript picture image is formed, a first reference signal generating means for generating a first reference signal which is used as the reference for a forming initiation position of an electrostatic latent image synchronously with the rotation of said photosensitive substance, developing means for developing said electrostatic latent image, transfer means for transferring the image developed through the instrumentality of said developing means to a recording paper, a second reference signal generating means for generating a second reference signal which is used as the reference for the transfer initiation position synchronously with the transfer operation of said transfer means, and timing signal generating means for generating timing signals which represent the grip timing for a transfer paper synchronously with the transfer operation of said transfer means, is characterized by including control means for controlling the positional relationship between said photosensitive substance and said transfer means with a predetermined relationship by employing abovementioned first and second reference signals and the timing signal before initiation or after the termination of the copying cycle.

According to the present invention, there are provided pulse generating means for generating a pulse signal synchronizing with the rotation of the transfer means, timing pulse generating means for generating timing pulses which represent the grip timing for a transfer paper synchronously with the rotation of said transfer means, and control means which counts said pulse signals after said timing signal is generated, and controls the transfer operation by recognizing the time when the count value reaches a predetermined value as the reference point for the transfer initiation point.

The control means counts said pulse signals after the grip timing signal is generated, and controls the transfer operation by recognizing the time when the count value reaches a predetermined value as the reference time. In this case, since the pulse generating means is composed of a pulse generating means of high accuracy, such as a rotary encoder, high accuracy is obtainable. Therefore, it is possible to have the latent image forming initiation point and the transfer initiation point coincide with each other with high accuracy.

According to the present device, there are provided pulse generating means for generating a pulse signal having a predetermined frequency, counting means for counting pulse signals generated by said pulse generating means from the picture image scanning termination point of the optical scanning mechanism, and control means for shutting down emergently the copying operation when said copying operation is not terminated when the value counted by said counting means reaches a predetermined value.

The control means shuts down the copying operation, judging that an abnormal matter has occurred in the pulse signal system when the counted value reaches a predetermined value.

According to the present device, there is provided control means which stops the copying operation when an overflow output is generated from counter means which rotates the transfer means in accordance with the difference between the pulse train corresponding to the target value of the rotation quantity of transfer means and the pulse signal which synchronizes with the rotation.

The control means judges that an abnormal matter has occurred when a overflow output is generated, and stops the copying operation thereafter.

According to the present invention, there are provided reference signal generating means for generating a reference signal which is used as the reference for the forming initiation position of the electrostatic latent image synchronously with the rotation of the photosensitive substance, and control means for having the optical scanning mechanism start when the rotation angle of the photosensitive substance reaches a predetermined angle based on the reference signal generated from said reference signal generating means.

The control means has the optical scanning mechanism start when the rotation angle of the photosensitive substance reaches a predetermined angle based on the reference signal synchronizing with the rotation of the photosensitive substance. As the result, even if nonuniformity in the rotation period of the photosensitive substance is produced, the synchronous relationship between the optical scanning mechanism and the photosensitive substance is kept fixed at all times, so far as the generating position of the reference signal, and the latent image forming initiation point are kept with a predetermined relationship, thus producing a copied picture image having uniformity of shade According to the present invention, the control time of acceleration or deceleration is limited to the interval until the point of the transfer paper reaches the transfer point after the transfer means has gripped the transfer paper.

Since the control time of acceleration or deceleration is limited to the interval until the point of the transfer paper reaches the transfer point after the transfer paper is gripped, the rotation speed of the transfer means before gripping is stable. Therefore, no misgripping will occur.

According to the present invention, there are provided, in control means for controlling respective means such as transfer means, a copy mode for controlling a series of copying processes by controlling abovementioned respective means, and a diagnosis mode for making a diagnosis of abovementioned respective means.

When the diagnosis mode is set up, and a diagnosis command corresponding to required contents of diagnosis is input, control means performs the commanded diagnosis operation.

DETAILED DESCRIPTION OF THE INVENTION

The present device will hereinafter be described at full length with reference to various preferred embodiments.

Figure 1:
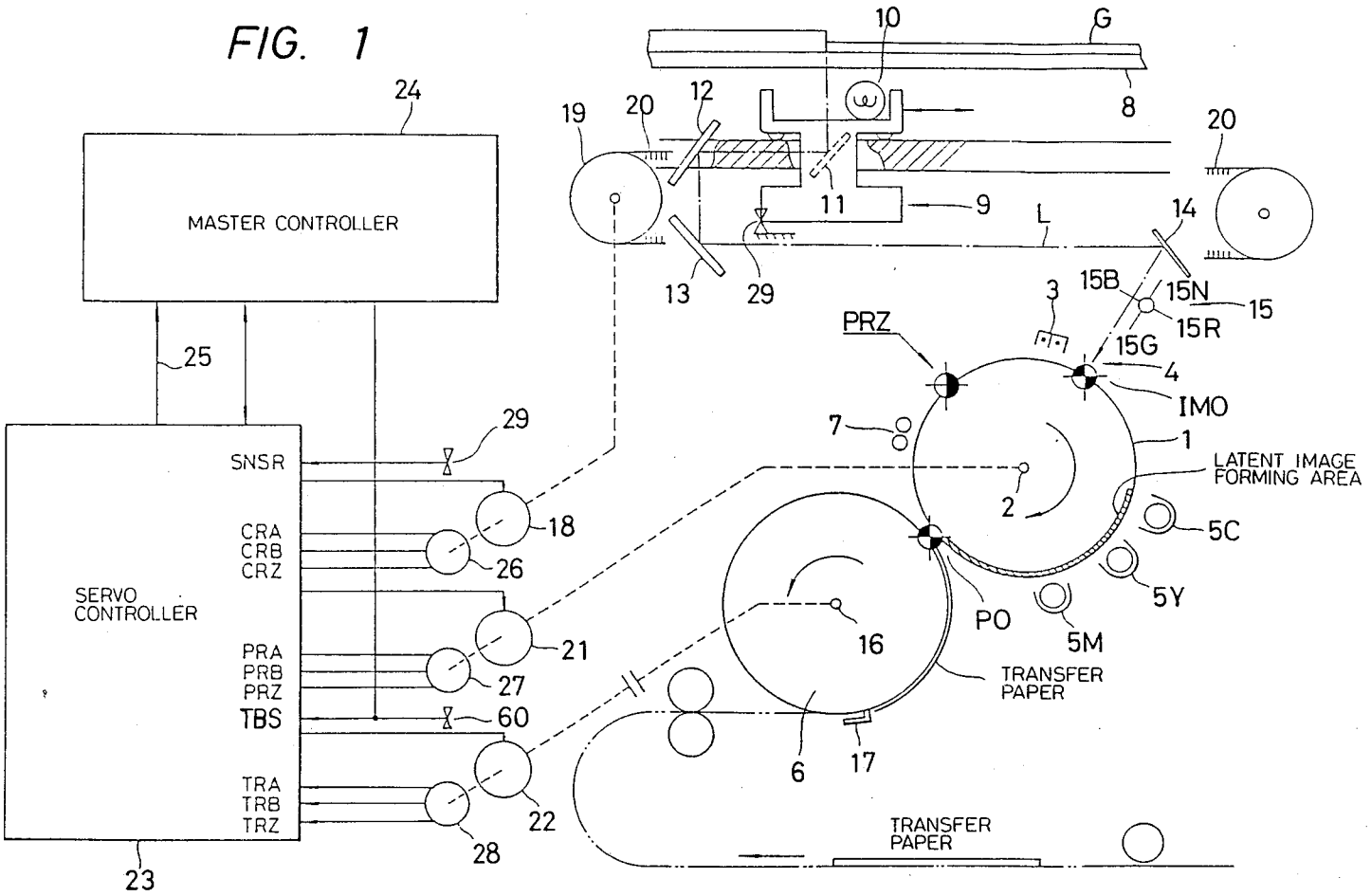
FIG. 1 is a general block diagram showing an embodiment according to the present device.

FIG. 1 is a general block diagram of a trichromatic separation type polychromatic copying machine. In the Figure, the reference numeral 1 denotes a drum type electronic photosensitive substance (hereinafter referred to as a photosensitive drum), which is driven at a circumferential speed V in the direction shown with an arrow mark, with the shaft 2 as the center. Reference numeral 3 denotes a charger for giving photosensitivity to the photosensitive drum 1, Reference numeral 4 denotes an exposure part, and 5Y, 5M, and 5C are color toner developing units corresponding to separated colors, which are color toner developing units for yellow, magenta and cyanogen colors, respectively, in the case of this embodiment. Reference numeral 6 denotes a transfer drum and reference numeral 7 denotes a photosensitive drum cleaner.

Reference numeral 8 denotes a manuscript placing table, and the manuscript G is placed on the table 8 with the picture image surface thereof facing downward. Reference numeral 9 is a manuscript scanning optical system exposing the photosensitive drum. This system consists of a first movable mirror 11, which reciprocates from the left to the right of the table along the bottom thereof at the same speed as the circumferential speed V of the photosensitive drum 1 together with a manuscript illuminator 10 under the manuscript placing table 8, and, which scans the manuscript surface placed face downward on the table 8 through the table 8, a second and a third mirrors 12 and 13 which reciprocate at the speed of $\frac{1}{2}$ of the circumferential speed of the photosensitive drum 1, and a fixed mirror 14. When a print start button (not shown) is depressed, illuminator and mirror 10 and 11 reciprocate (hereinafter, movable optical system) and the manuscript picture image is scanned from the left to the right in successive order through the table 8. The scanning light L is transmitted through the path of the first mirror 11 to the second mirror 12 to the third mirror 13 to the fourth mirror 14, and image-formation is made by means of an exposure part 4 on the surface of the photosensitive drum under rotating state.

Reference numeral 15 designates a color separation filter unit, wherein 4 pieces of filters, a blue ray transmission filter 15B, a green ray transmission filter 15G, a red ray transmission filter 15R, and a neutral filter 15N are mounted radially at the interval of 90° on the rotating shaft of the filter unit 15. By rotating the rotation shaft by 90° at a time, every filter is positioned in the light path of the scanning light L. Furthermore, this filter unit 15 and respective color developing units 5Y, 5M, and 5C are associated. In other words, the yellow toner developing unit 5Y is operated when the blue filter 15B is located at the switched position in the light path of the scanning light L the magenta toner development unit 5M is operated when the green filter 15G is at the switched position and the cyanogen toner developing unit 5C is operated when the red filter 15R is at the switched position.

On the other hand, the transfer drum 6 is rotated in the direction shown with an arrow mark with the shaft 16 as the center at the same circumferential speed as the photosensitive drum 1. The transfer paper fed from a paper feeding part (not shown) to the drum 6 is held by a clipper 17 and is rotated together with the drum 6 under wound state a round the circumferential surface of the drum 6.

Accordingly, when the print start button is depressed after setting the manuscript G on the table 8, a series of picture image forming processes, such as charging, exposure, development, transfer and cleaning, are executed repeatedly for every color separated image of the manuscript, thereby producing a color print.

In this case, the picture image forming process is initiated for the first color separated image by means of the print start button, but the picture image forming process is initiated for the second and the third colors by means of generation of a print restart signal inside the circuit when the previous process is completed.

In other words, when it is presumed that the color separation is performed in the order of blue, green and red, the blue filter 15B intervenes in the exposure light path when the picture image is formed for the first time, and the blue color component image of the manuscript image is formed on the photosensitive drum surface as a yellow toner image, which has a complementary color relationship with the blue color, by the action of the yellow toner developing unit 5y. The yellow toner image is then transferred onto the transfer paper surface wound around the circumferential surface of the transfer drum 6.

When the picture image is formed for the second time, the green filter 15G intervenes in the exposure light path, and the green color component image of the manuscript image is formed on the surface of the photosensitive drum as a magenta toner image, which has a complementary color, relationship with the green color by the action of the magenta toner developing unit 5M. This magenta toner image is further transferred with supereposition on the transfer paper surface on which transfer process of the yellow toner image has been made already and which is still under wound state around the drum 6.

When the picture image is formed for the third time, the red filter 15R intervenes in the exposure light path, and the red color component image of the manuscript image is formed on the surface of the drum 1 as a cyanogen toner image, which has the complementary color relationship with the red color, by the action of the cyanogen toner developing unit 5C. This cyanogen toner image is transferred with superposition on the transfer paper surface on which the yellow toner image and the magenta toner image have already been transferred as described above.

In such a way, a polychromatic image that is the same as the manuscript image is formed by composition on the transfer paper surface by means of transfer with superposition of the abovementioned respective color toners. Then, after the abovestated repeated transfer process is completed, the transfer paper held on the drum 6 is separated from the drum 6, and fed to a fixing unit (not shown) by a conveyor unit (not shown) to be subjected to the fixing process ejected from a paper ejecting tray as a polychromatic print.

The movable optical system, the photosensitive drum 1, and the transfer drum 6 are moved or energized for rotation by means of independent motors, respectively. In other words the power source for the movable optical system 10 and 11 is provided by a motor 18 (hereinafter referred to as a CRG motor 18) through a pulley 19 and a wire 20. The power sources for the photosensitive drum 1 and the transfer drum 6 are provided by a motor 21 (hereinafter referred to as a PR motor 21) and a motor 22 (hereinafter referred to as a TR motor 22), respectively. These CRG motor 18, PR motor 21 and TR motor 22 are controlled by means of a servo controller 23. The servo controller is further controlled by a master controller 23 as host control means. The master controller 24 receives IMS signal and PRZ signal, etc., which will be described later, from the servo controller 23 and executes the control, abnormality diagnosis processing, and so forth of the whole copying cycle. In addition, the servo controller 23 and the master controller 24 are coupled by a serial data line 25 in addition to the abovementioned respective signal lines.

Figure 3:
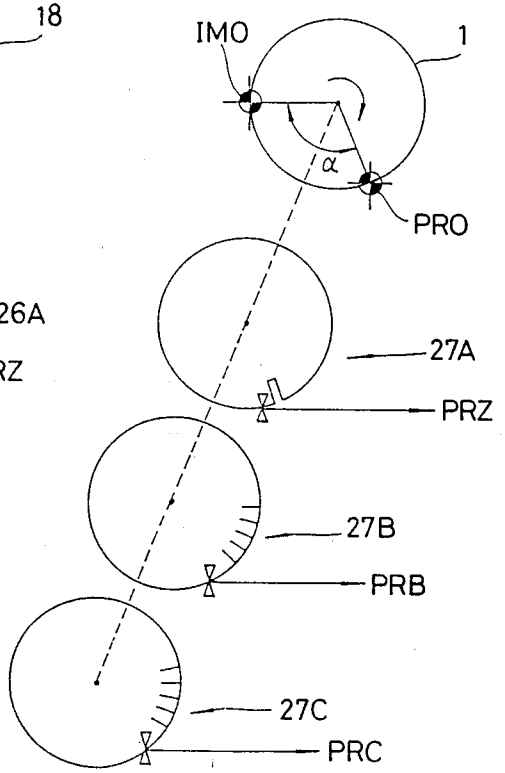
Figure 2:
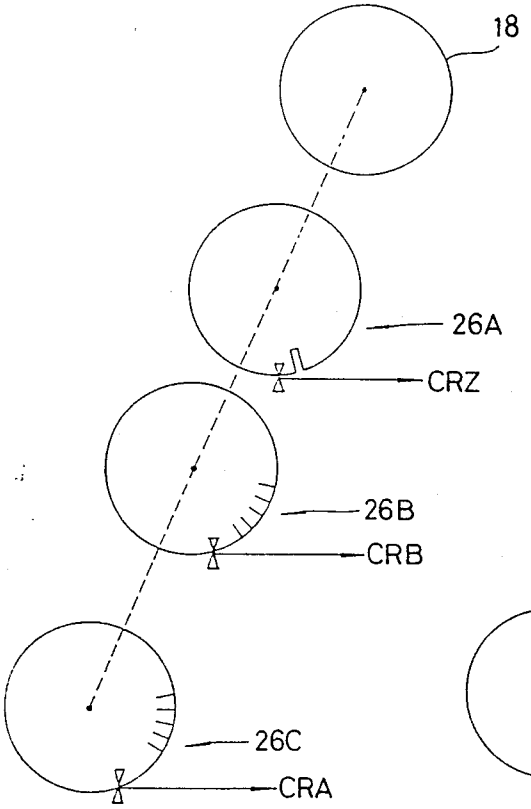

The CRG motor 18, the PR motor 23 and the TR motor 22 have pulse generators 26, 27, and 28 provided on their respective rotation shafts for generating pulse signals that synchronize with the rotation o each motor, respectively. In other words, as shown in FIG. 2, on the rotation shaft of the CRG motor 18 are mounted a pulse generator 26 consisting of a rotary encoder 26A for generating a rotation pulse signal CRZ that shows one rotation of said motor 18, a rotary encoder 26B for generating one pulse signal CRB for every predetermined rotation angle of the CRZ motor 18, and a rotary encoder 26C for generating a pulse signal CRA having a phase angle that is 90 degrees different from abovementioned signal CRB. In the similar manner, as shown in FIG. 3 on the rotation shaft of the PR motor 21 are mounted a pulse generator 27 consisting of a rotary encoder 27A for generating a rotation pulse signal PRZ that shows one rotation of the photosensitive drum 1, a rotary encoder 27B for which generating one pulse signal PRB for every predetermined rotation angle of the PR motor 21, and a rotary encoder 27C for generating a pulse signal PRA having a phase angle 90 degrees different from abovementioned signal PRB. In this case, PRO of the photosensitive drum 1 shown in FIG. 3, is the rotation initiation point of the drum 1, and the encoder 27A is mounted in such a way that the signal PRZ is generated at a rotation timing approximately corresponding to the rotation initiation point PRO. In addition, IMO is a forming initiation point of the electrostatic latent image and is located at the position shifted from PRO by degrees.

Figure 4:
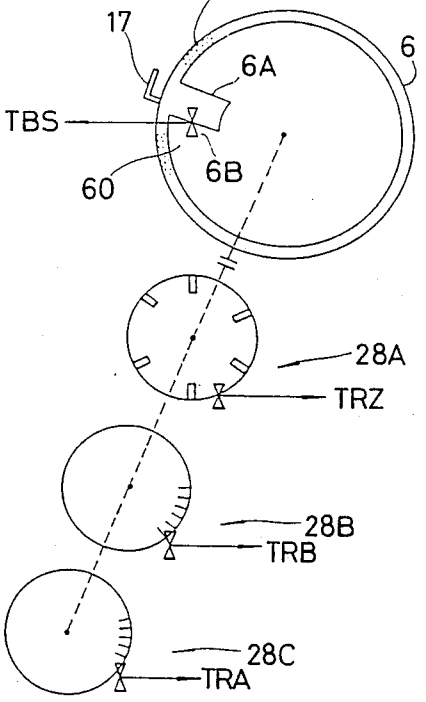
FIGS. 2 to 4 are detailed block diagrams of a pulse generator for generating pulses synchronously with the rotation of a CRG motor, a PR motor and a TR motor.

Furthermore, as shown in FIG. 4, on the rotation shaft of the TR motor 22 are mounted a pulse generator 28 consisting of a rotary encoder 28A that outputs one pulse signal TRZ per rotation of said motor 22 (provided, 6 pulse signals per rotation of the transfer drum 6 due to a decelerating mechanism located between the TR motor 22 and the transfer drum 6) at an equal interval, a rotary encoder 28B that generates one pulse signal TRB for every predetermined rotation angle of the TR motor 22, and a rotary encoder 28C that generates a pulse signal TRA having a phase 90 degrees different from that of above mentioned signal TRB. Moreover, a protruded actuator 6A is provided at a position corresponding to the position of a gripper 17 on the internal circumferential surface of the transfer drum 6, which actuates the sensor 6B fixed to the frame, thereby to take out the grip timing signal TBS of the transfer paper.

Hereafter, the pulse generator consisting of the actuator 6A and the sensor 6B is referred to as the TR sensor 60.

The servo controller 23 predicts the grip timing of the transfer paper by counting the output signals of the encoder 28B or 28C with the output signal TBS of the TR sensor 60 as the reference, and further calculates the time (distance or position) required for the grip position at the predicted timing to practically reach the transfer initiation point PO. The servo controller 23 further accelerates or decelerates the speed of the TR motor 22 so that the latent image forming initiation point IMO and the transfer initiation point PO may coincide with each other.

In FIG. 1, a switch 29 provided at a location apart from the home position of the movable optical system 10 and 11 at a predetermined distance in the operating direction, is employed for the purpose of detecting the scan initiation timing of the picture image. The operation timing of this switch (hereinafter referred to as the REG sensor) 29 is employed as the scan initiation timing.

Figure 5A:
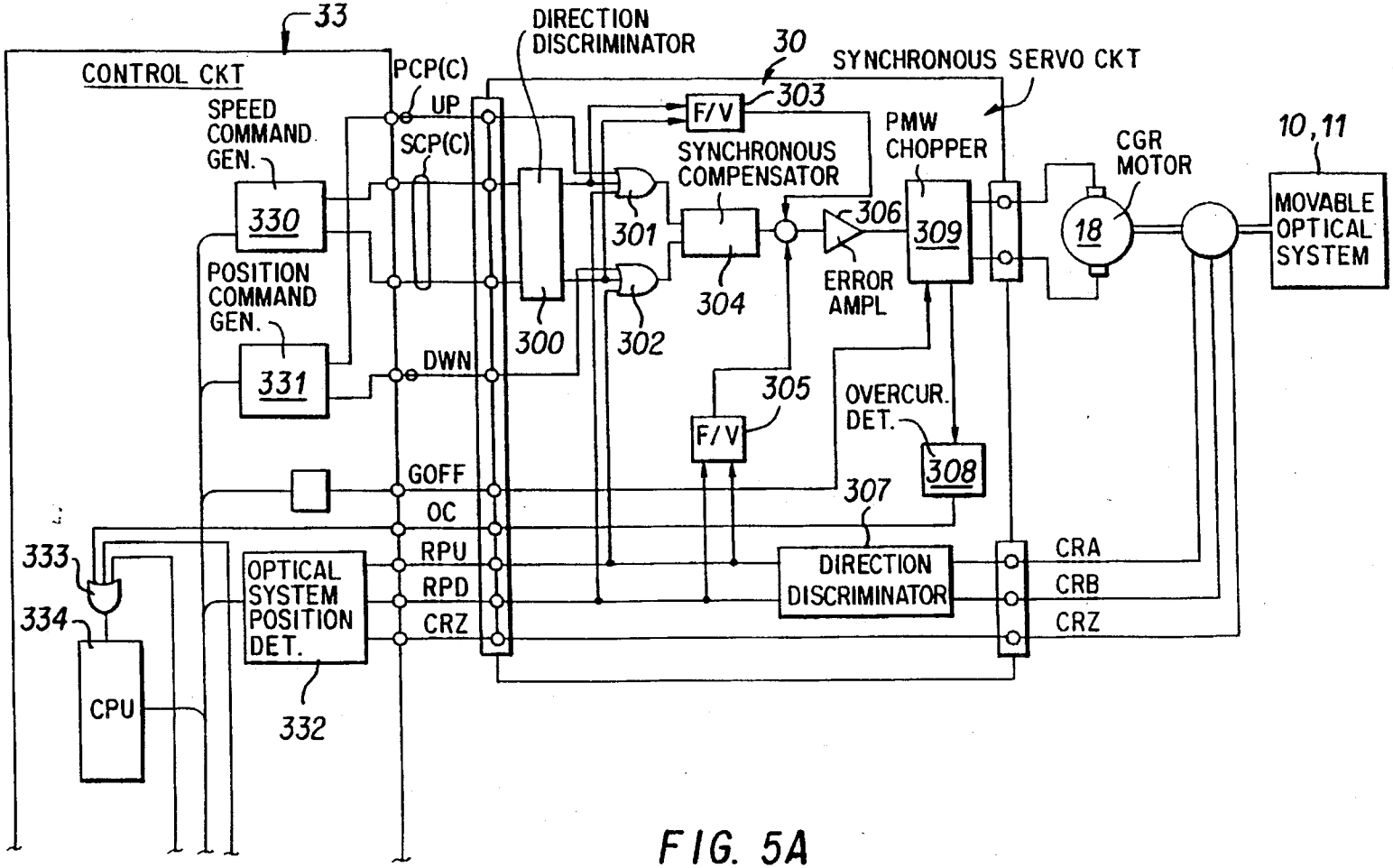
FIG. 5A and 5B are detailed block diagram of a servo controller.
Figure 5B:
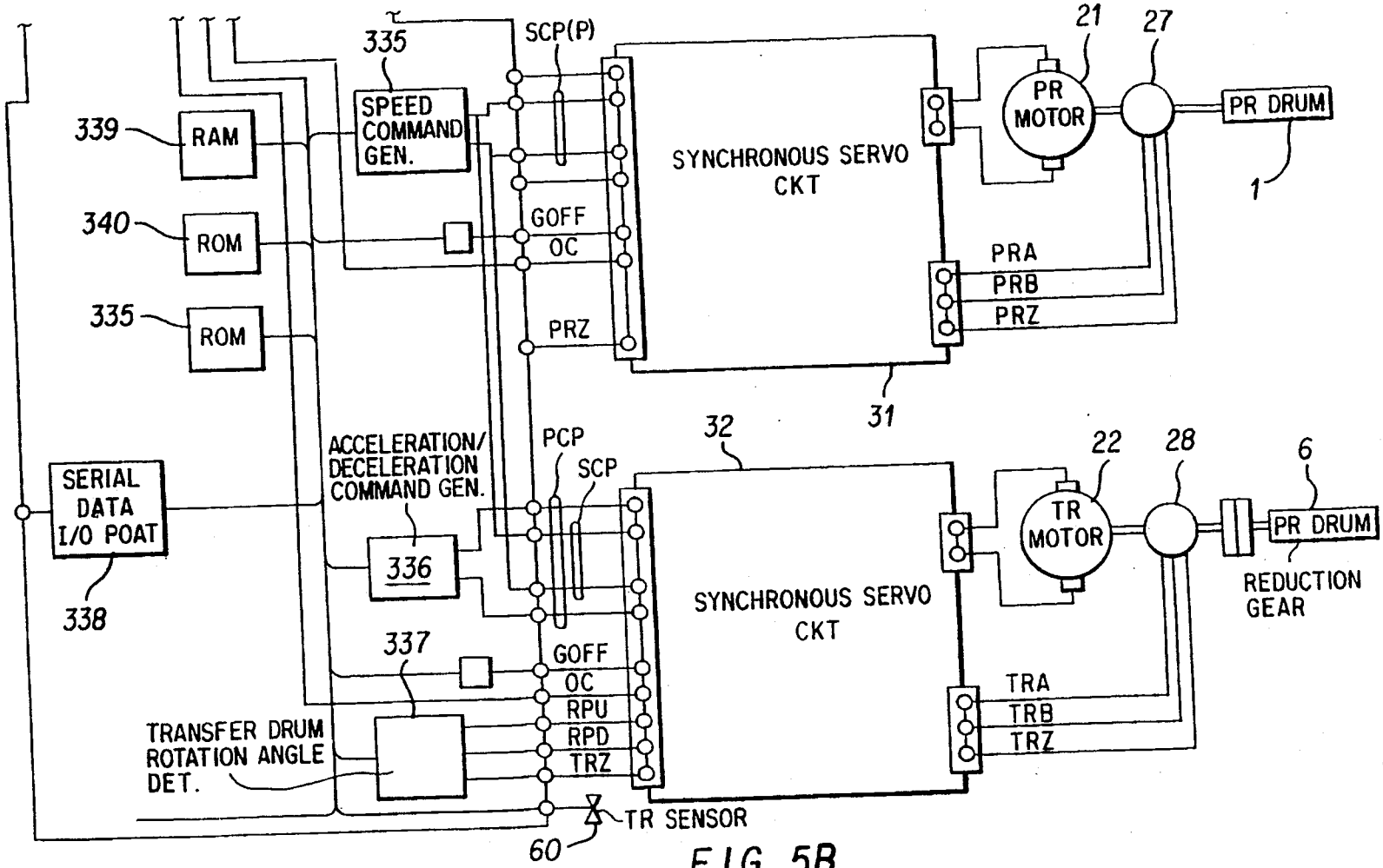

FIG. 5 is a block diagram showing the detailed constitution of the servo controller 23. Roughly dividing, the servo controller 23 consists of three systems of synchronous servo circuits 30, 31, and 32, which control the rotation status of the CRG motor 18, the PR motor 21, and the TR motor 22 independently of the target rotation status, and a control circuit 33, which controls above-mentioned synchronous servo circuits in a predetermined synchronous relationship.

As to respective synchronous servo circuits 30 thru 32, the synchronous servo circuit 30 of the CRG motor 18 will be described as a unit representing others. THe synchronous servo circuit 30 consists of a direction discriminator 300, OR-gates 301 and 302, an FV converter 303, a synchronous compensator 304, an FV converter 305, an overcurrent detector 308 and a PWM chopper 309. To the input of the control circuit side thereof are input a speed command pulse SCP composed of signals in phase A and phase B having 90 degree phase difference, which are output from a speed command generator. 330 of the control circuit 33, a position pulse PCP composed of an UP signal and a DOWN signal which are output from a position command generator 331 of the control circuit 33, and a gate off pulse GOFF which cuts off the output gate of the PWN chopper 309. Moreover, the overcurrent detection signal of the overcurrent detector 308 and the direction of rotation detection signals RPU and RPD, which show whether the direction of rotation of the CRG motor 18 detected with the direction discriminator 307 is in the normal direction of rotation (UP) or in the reverse direction of rotation (DOWN), are output to the control circuit side. Furthermore, the output signal CRZ of the pulse generator 26A is output to the side of the control circuit 33 as it is. These signals RPU, RPD, and CRZ are input to the optical system position detector 332, thereby to detect the picture image scan position of the movable optical system 10 and 11. The overcurrent detection signal OC is input as the interrupt signal of a microprocessor (CPU) 334 through an OR-gate 333 of the control circuit 33 and when an overcurrent flows in the CRG motor 18, emergency shutdown of the CRG motor 18 is executed by the interrupt processing of the CPU 334. Furthermore, the overcurrent detection signals for the PR motor 21 and the TR motor 22 are input to the OR-gate 333 likewise.

In this case, as to the PR motor 21, no position control is performed, but only the speed control is performed. Therefore, the position control pulse is not input to the synchronous servo circuit 31, but only the speed command SCP(P) is input from the speed command generator. As to the TR motor 22, since it is necessary to perform acceleration/deceleration control of the TR motor 22 to have the transfer initiation point coincide with the latent image forming initiation point, the speed command pulse SCP(T) and the position command pulse PCP(T) are input from the acceleration/deceleration command generator 336.

In order to perform acceleration/deceleration control in this case, the direction of rotation detection signals RPU, RPD, and the output signals TRZ of the pulse generator 28A are input to a transfer drum rotation angle detector 337, and the present rotation angle of the TR drum 6 is detected by these signals. The CPU 334 has the generator 336 generate the acceleration/deceleration command pulse by means of the rotation angle detection signal so that the transfer initiation point and the latent image forming initiation point may coincide with each other.

The basic operation of the control circuit 33 is controlled by the CPU 334, but this CPU 334 executes the control operation based on control programs or control parameters that are stored in ROMs 335, 340 or RAM 339. In this case, the console panel contains switches for setting well-known copy modes, such a number of copy sheets, the blank form size an the reduction/enlargement ratio, and a copy start switch. The console panel further contains an abnormality display lamp and a switch for setting a command for diagnosis for the purpose of maintenance and inspection and, is connected to the master controller 24. This switch information is sent to and received from the master controller 24 through a serial data I/O port 338.

Next, the operation of the synchronous servo circuit of the CRG motor 18 will be described hereunder.

First, when it is assumed that only the speed command pulse SCP(C) is input without applying the position command pulse PCP(C), the direction discriminator 300 discriminates the direction of the rotation command through the instrumentality of the phase difference between the phase A and the phase B of said pulse SCP(C), and generates a command pulse SPA corresponding to the command direction described above. In other words, in case of the direction of normal rotation, the direction discriminator 300 outputs SPA, which has a period corresponding to the target speed commanded by the speed command pulse and in case of the direction of reverse rotation, the direction discriminator outputs SPB, which has a period corresponding to said target speed.

Among these signals, the signal SPA is input to a synchronous compensator 304 through an OR-gate 301 and also to an FV converter 303 at the same time. The signal SPB is input to the synchronous compensator 304 through an OR-gate 302 and also to the FV converter 303 at the same time.

When the signal SPA or SPB is input, the FV converter 303 converts the signal into a voltage signal corresponding to the period thereof, and inputs said voltage signal to an error amplifier 306 as the speed command.

On the other hand, the synchronous compensator 304 is constituted in such a way that it converts the count value of the up-down counter into an analog signal, performs non-linear conversion of said signal by employing a route amplifier thereafter, and inputs said analog signal to the error amplifier 304 as a synchronous error signal. Thus, the output signal of the OR-gate 301 is applied to the input of the up-count input of above-mentioned up-down counter, and the output signal of the OR-gate 302 is applied to the input of the down-count input thereof.

Accordingly, when the speed command pulse SCP(C) is input corresponding to the target speed, a speed command and a synchronous error signal at the voltage corresponding to the period of this pulse SCP(C) are input to the error amplifier 306. Then, the error amplifier 306 controls the conduction angle of the PMW chopper 309 by means these input and applies electric current corresponding to the target speed to the CRG motor 18. When the CRG motor 18 is started rotate through the abovementioned operation, signals CRA and CRB, having periods corresponding to the rotation speed of the motor 18, are input from pulse generators 26A and 26B.

Then, the direction discriminator 307 corresponds to the present direction of rotation of the CRG motor 18 depending on lead-lag of phases of these signals CRA and CRB, and outputs a pulse signal RPU or RPD, having a period in proportion to the rotation speed. This signal RPU or RPD is input to the FV converter 305 and converted into a voltage signal corresponding to the period thereof, and is input to the error amplifier thereafter as a speed feedback signal. The deviation between the voltage signal of the speed command and the speed feedback signal is detected by the error amplifier 306, thereby to control the output current of the PWM chopper 309 so that the deviation becomes zero. On the other hand, the output signal RPU of the direction discriminator 307 is input to the OR-gate 302, and the output signal RPD is input to the OR-gate 301. With this, when the CRG motor 18 is started to rotate in the normal direction, the signal RPU is input to the down-count input of the synchronous compensator 304. In contrast when the CRG motor is started to rotate in the reverse direction, the signal RPD is input to the up-count input. Therefore the count value becomes smaller in the synchronous compensator 304 as the CRG motor 18 rotates, but the analog conversion voltage of the count value thereof is input to the error amplifier 306 as a synchronous error signal. Therefore, the output current of the PWM chopper 309 is also varied by the synchronous error signal. As the result of such control, the CRG motor 18 will rotate in a phase synchronized with the speed command pulse SPC(C) and at a speed corresponding to the command speed.

On the other hand, when the command pulse PCP(C) is input, an error voltage corresponding to the deviation between the phase of said pulse PCP(C) and the phase of the output pulse RPU or RPD of the direction discriminator 307 is output from the synchronous compensator 304, and the position of the movable optical system is set at the target position by varying the output current to the CRG motor 18 so that the error voltage becomes zero.

Figure 6:
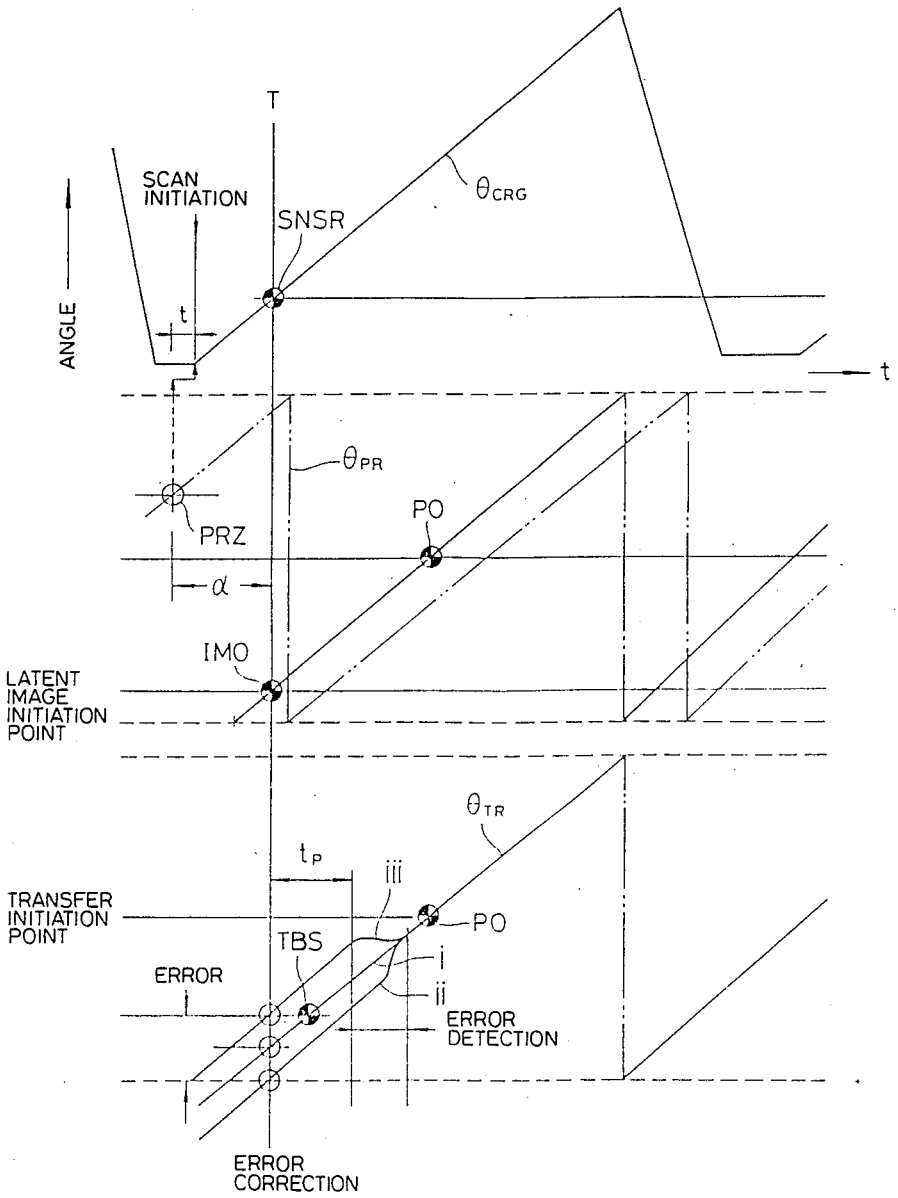
FIG. 6 is a time chart for explaining the operation of a copying cycle.

In the configuration such as described above, a series of copying cycles are executed with processes as as follows. FIG. 6 is a time chart showing respective rotation angles $\theta_{CRG}$, $\theta_{PR}$ and $\theta$TR of the CRG motor 18, the pR motor 21 an the TR motor 22 and synchronous relationship thereof, and the X-axis and the Y-axis represent time and rotation angle, respectively.

In the first place, when the PR motor 21 is started and the signal PRZ is generated, the CRG motor 18 is started after the time t. Then, when the movable optical system 10 and 11 reaches the position of the REG sensor 29 and the scan initiation timing signal SNSR is output from said sensor 29, electrostatic latent images are formed in consecutive order starting from the electrostatic latent image forming initiation position IMO of the photosensitive drum 1 prescribed by the generation timing of the timing signal SNSR.

On the other hand, the TR motor 22, which is the power source of the transfer drum 6, is started almost simultaneously with the PR motor 21. At the timing T when the signal SNSR was output, however, the time required for the grip timing signal TRS of the transfer paper to be generated is forecast, and, if the rotation speed VPR of the transfer drum 6 is at such a speed that the latent image forming initiation point IMO and the transfer point PO coincide with each other judging from the forecast value, the TR motor 22 is accelerated under the accelerating state as shown with the variable-speed line i. However, when it is judged that the time up to the signal TRS is shorter than the normal value as shown with the variable-speed line iii, viz., in case it is judged that the grip timing so as to reduce the speed of the motor 22 after the time tp for the purpose of having the grip timing coincide with the normal timing. Conversely, when the time up to the signal TRS is longer than the normal value as shown with a variable-speed line ii, the acceleration control of the TR motor 22 is initiated after the time tp so as to have the grip timing coincide with the normal timing. Such acceleration/deceleration control is performed by varying the period of the acceleration/deceleration command pulse, which is output from the acceleration/deceleration command generator 336 shown, in FIG. 5.

Thus, the latent image forming initiation point IMO and the transfer initiation point coincide with each other, thereby to forming of a picture image having no color shear. In the polychromatic copying, such a process is repeated three times, thereby to form a polychromatic print.

In order to form a polychromatic print having no color shear, it is necessary to perform, in addition to the position control of the transfer initiation point by the instrumentality of acceleration/deceleration control of the TR motor 22 as described above, synchronous control between the PR motor 21 and the CRG motor 18, position control for the purpose of having the movement of the movable optical system 10 and 11 start from the normal home position, control of the starting positions of the PR motor 21 and the TR motor 22 for the purpose of having the latent image forming initiation point IMO and the scan initiation timing coincide with each other, and further, control at the time when abnormal state occurs in cases signals PRZ and TRZ, etc. are no longer output.

The details of control will hereinafter be described in detail.

(1) Position control of the movable optical system

As described above, the motive power to move the movable optical system is conveyed through wires and pulleys. Accordingly, when the movable optical system is returned to the stop position (starting position when copying is initiated), the stop position of the movable optical system 10 and 11 is shifted in every copying cycle due to the status change of the motive power transmission mechanism and so forth, the running distance of the movable optical system becomes different when copying initiation is made again, and the position relationship between the manuscript picture image and the copied picture image, or the position relationship between respective colors does not coincide, which appears as a color shear in the polychromatic copying machine. Accordingly, it is necessary to always control the stop position of the movable optical system at the normal stop position in order to prevent such color shear from occurring.

In order to meet such requirements, measuring means for measuring the time required from the operation timing of the REG sensor 29 to the stop of the movable optical system by counting the rotation pulse signal CRB or CRA are provided inside the servo controller 23 in the embodiment shown in FIG. 1. Specifically, the abovesaid arrangement is incorporated in the control program of the CPU 334. Furthermore measurement by employing said measuring means is executed at predetermined times such as immediately before copying initiation of the first copy or immediately before shifting to a series of copying cycles.

Specifically, the movable optical system 10 and 11 is moved in the direction of scanning the manuscript picture image at either time described above, and measurement is made as shown in FIG. 7, with the generation timing of the output signal SNSR of the REG sensor 29, which was operated when said optical system was returned to the stop position thereof as the reference, on the time ND required from said reference timing to the generation timing of the reference signal CRZ.

Then, the time required to obtain $$NS=C-ND \quad (1)$$

After the reference signal CRZ is generated is measured by means of the rotation pulse CRA or CRB when the movable optical system 10 and 11 is returned to the stop position thereof, and the CRG motor 18 is stopped after the time NS has passed after the signal CRZ was generated.

The distance between the position where the REG sensor 29 is operated and the stop position of the optical system 10 and 11 is always controlled to keep the relationship $NS+ND=C$.

As the result, even if there is any state change in the motive power transmission mechanism, such as the wire 20 which moves the movable optical system 10 and 11, the starting position of the movable optical system 10 and 11 always remains at the same position, thus eliminating position dislocation or color shear in the copied picture image.

(2) Control of starting positions of the PR motor and the TR motor

On the circumferential surface of the transfer drum, a plastic net 61 for the purpose of attracting the transfer paper by static electricity is formed in the length corresponding to the maximum length of the transfer paper as shown in FIG. 4. If the picture image forming area of the photosensitive drum 1 stops at the portion of this plastic net 61, abnormal transfer, viz., so-called deletion is generated at the time of transfer. Therefore, it is necessary to stop the PR motor 21 and the TR motor 22 so that the electrostatic latent image forming area of the photosensitive drum 1 and the plastic net do not coincide with each other. Besides, such relationship must also be returned to the normal position relationship when the relationship between both is shifted due to a paper jam.

Accordingly, the starting position relationship of both motors is controlled in a preferred embodiment by starting the PR motor 21 and the TR motor 22 before and at the time of completion of a series of copying cycles, by counting the signal PRA (or PRB) and the signal TRA (or TRB) with the signals PRZ and TRZ as the reference, respectively, and by stopping the PR motor 21 and the TR, motor 22 when such a positional relationship is obtained that the electrostatic latent image forming area and the plastic net 61 are not overlapped.

Figure 8:
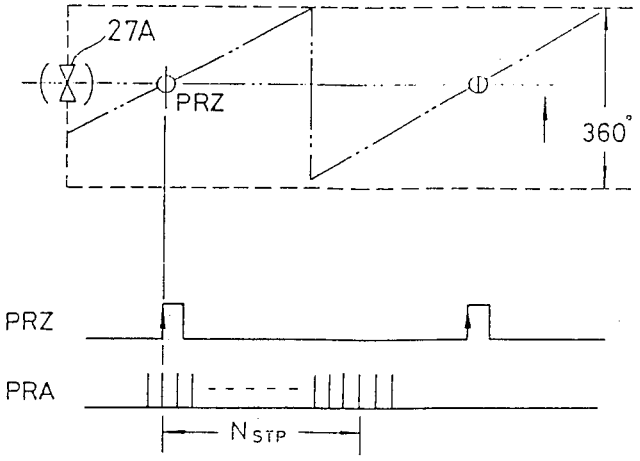
FIG. 8 is a time chart for explaining the start positioning control of a photosensitive drum.
Figure 9:
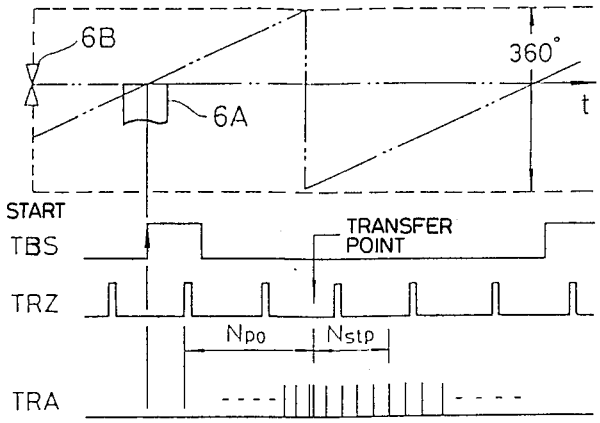
FIG. 9 is a time chart for explaining the start positioning control of a transfer drum.

In other words, for the PR motor 21, as shown in the time chart of FIG. 8, the signal PRA (or PRB) is counted with the signal PRZ as the reference and the PR motor 21 is stopped when the count value reaches a predetermined value $N_{STP}$. Further, for the TR motor 22, as shown in the time chart of FIG. 9, the Signal TRA (or TRB) is counted from the generation timing of the signal TRZ, which appears in the first place after rising of the signal TBS and control is performed to stop the TR motor 22, after a count value $N_{PO}$ is reached where the gripper 17 passes the transfer point PO. At the time when the count value "$N_{PO}+N_{NTP}$" obtained by adding the count value $N_{STP}$, which is the count value to stop the PR motor 21 is reached.

In such a way, the photosensitive drum 1 and the transfer drum 6 are controlled in such a positional relationship where the electrostatic latent image forming area and the portion of plastic net 61 are not overlapped. This position control is performed immediately, before or at the time of completion of, a series of copying cycles.

As the result, even if the positional relationship between the photosensitive drum 1 and the transfer drum 6 is shifted due to a paper jam, etc., control is performed to keep normal positional relationship after the paper jam, thus forming a polychromatic copied picture image of good quality.

(3) Start synchronous control of the movable optical system and the photosensitive drum When the synchronous relationship between the start timing of the movable optical system and the photo-sensitive drum 1 is shifted, the degree of fatigue of the photosensitive drum surface in the electrostatic latent image forming area differs partly because the exposure point IMO is shifted. Therefore, nonuniformity in shade is produced, deteriorating the picture quality. Heretofore, time is measured beginning with the start timing of the movable optical system 10 and 11, and the movable optical system has been activated again when the measured time reaches the copying initiation time for the next color so as to start the photosensitive drum 1 and to form the electrostatic latent image in the next color. In this case, however, a problem has occurred because the synchronous relationship between the movable optical system and the photosensitive drum 1 is shifted in every copying cycle for each color due to nonuniformity of the rotation period of the photosensitive drum 1 and the accuracy of the software timer for measuring the time, Such dislocation is accumulated and results in bigger nonuniformity in shade for each color.

Figure 10:
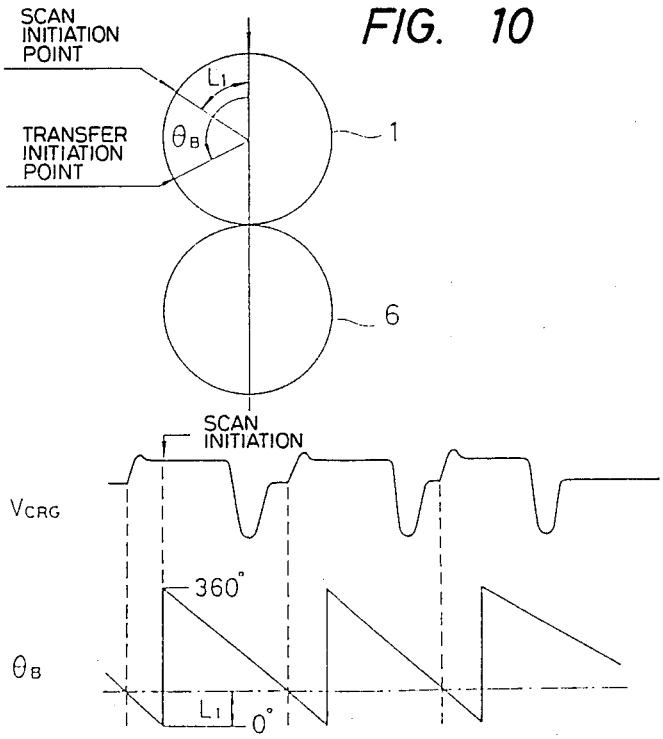
FIG. 10 is a time chart for explaining the start synchronous control of a movable optical system and a photosensitive drum.

Accordingly, in the present embodiment, a counter for counting the signal PRA or PRB with the signal PRZ as the reference angle is provided inside the servo controller 23 so that the movable optical system 10 and 11 is activated whenever the rotation angle $\theta_B$ of the photosensitive drum 1 shown with the count value of said counter reaches a fixed rotation angle $L_1$ as shown in the time chart of FIG. 10.

With such an arrangement, even if nonuniformity of the rotation period of the photosensitive drum 1 is produced, the synchronous relationship between the movable optical system 10 and 11 and the photosensitive drum 1 is always maintained, so long as the generating position of the signal PRZ and the latent image forming initiation point IMO are maintained with a relation at $\alpha$ degrees as shown in FIG. 3, thereby to producing a copied picture image having no nonuniformity in shade.

(4) Transfer initiation position control

As previously described, acceleration/deceleration control of the transfer drum 6 is performed so that the transfer initiation point PO and the latent image forming initiation point IMO, coincide with each other with the signal TRZ 6 pulses of which are output per rotation of the drum 6 and the output signal SNSR of the REG sensor 29 as the reference, but the accuracy of the TR sensor 60, which generates the signal TBS, is low, and a 1:6 gear is interposed between the TR motor 22 and the transfer drum 6. As the result, the transfer initiation point PO and the latent image forming initiation point IMO slip off each other even when only one tooth of the gear is dislocated.

Figure 11:
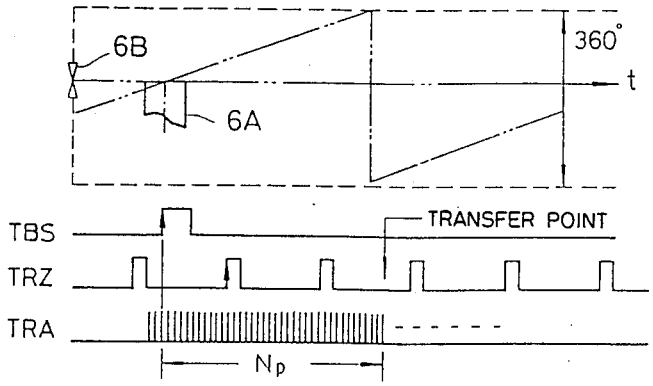
FIG. 11 is a time chart for explaining the transfer initiation point control of the transfer drum.

Therefore, in this embodiment, as shown in FIG. 11, the signal TRA or TRB is counted with the signal TRZ, which appears in the first place after the signal TBS is generated, as the reference, and it is judged that the time when the count value reaches the value corresponding to the normal transfer point PO is the transfer point PO, thus controlling the transfer initiation position.

Thus, the latent image forming initiation point IMO and the transfer initiation point coincide with each other with high accuracy.

(5) Acceleration/deceleration control of the transfer drum

It is required for the transfer paper to be held and conveyed by the gripper 17 of the transfer drum 6 so that the point position of the transfer paper coincides with the transfer initiation point IMO at the transfer initiation point PO. Accordingly, it is required to detect the present position of the gripper 17 when scanning of the picture image is commenced, and to perform acceleration/deceleration control of the rotation speed of the transfer drum 6 so that the detected position coincides with the latent image forming initiation point IMO at the transfer point PO. Heretofore, a positional error of the gripper 17 has been detected in the scan initiation timing for the picture image, and acceleration/deceleration control of the transfer drum has been immediately executed based on said positional error. In this case, however, since the rotation speed of the transfer drum 6 is varied immediately before the grip operation on the transfer paper, Misgripping has sometimes occurred.

Therefore, in the present embodiment, as described with reference to FIG. 6, after the gripper positional error is detected in the scan initiation timing, acceleration/deceleration control is executed starting at the time tp after the time when the grip operation is practically completed so as to complete the control before the transfer PO is reached. This is performed by providing software timer for measuring the time tp inside the servo controller 23.

Therefore, it is made possible to perform acceleration/deceleration control of the transfer drum without creating misgripping.

(6) Countermeasures against abnormality

Since the photosensitive drum 1, the transfer drum 6, and the movable optical system 10 and 11 are controlled by independent motors and the servo loops thereof, respectively, in the present embodiment as described previously, a position control for positioning respective relationship at normal positions before initiating the copying cycle is required. However, such position control is executed based on the pulse signals (PRZ, TRZ, etc.) that synchronize with the rotation of each motor. Accordingly, when an abnormal matter occurs in these pulse signals or signal paths thereof, the positioning not only becomes impossible, but a situation arises where the motor remains in an accelerated condition even after passing the specified position, which may cause serious troubles such as burning of motor windings and driving circuits thereof.

Figure 12A:
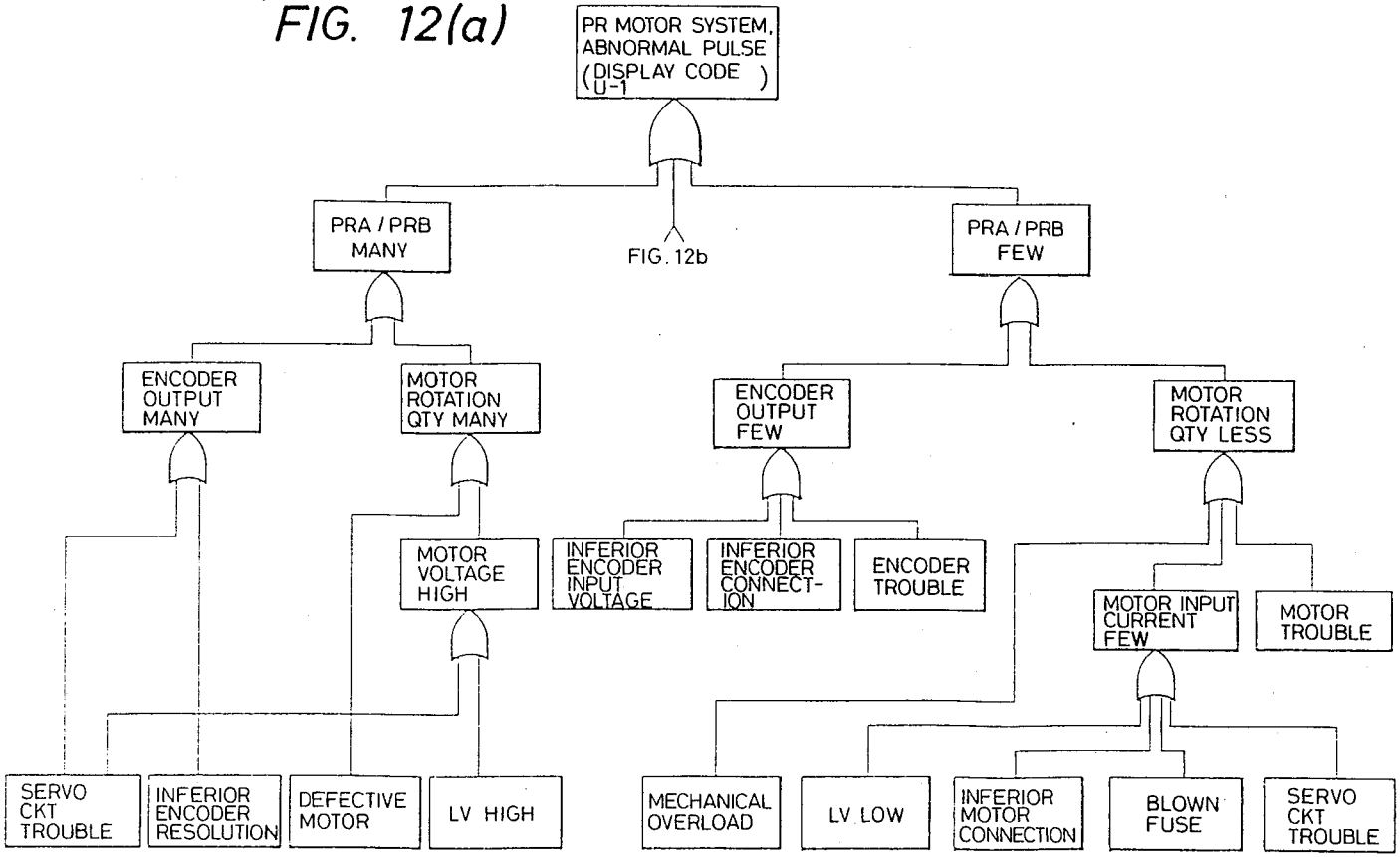
FIGS. 12*a*, 12*b*, and 13*a*, 13*b*, 13*c* are abnormal phenomena system drawings showing abnormal phenomena and causes thereof of pulse generators in the PR motor system and the TR motor system.
Figure 12B:
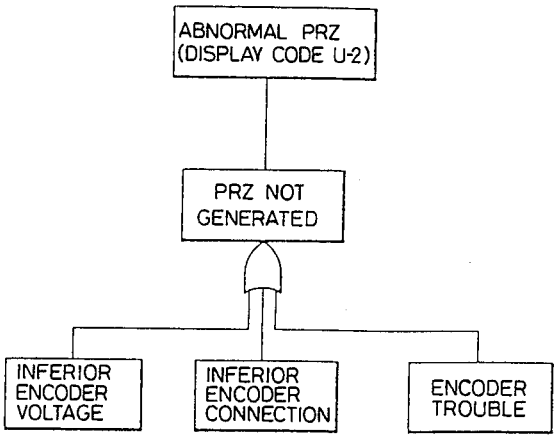
Figure 13A:
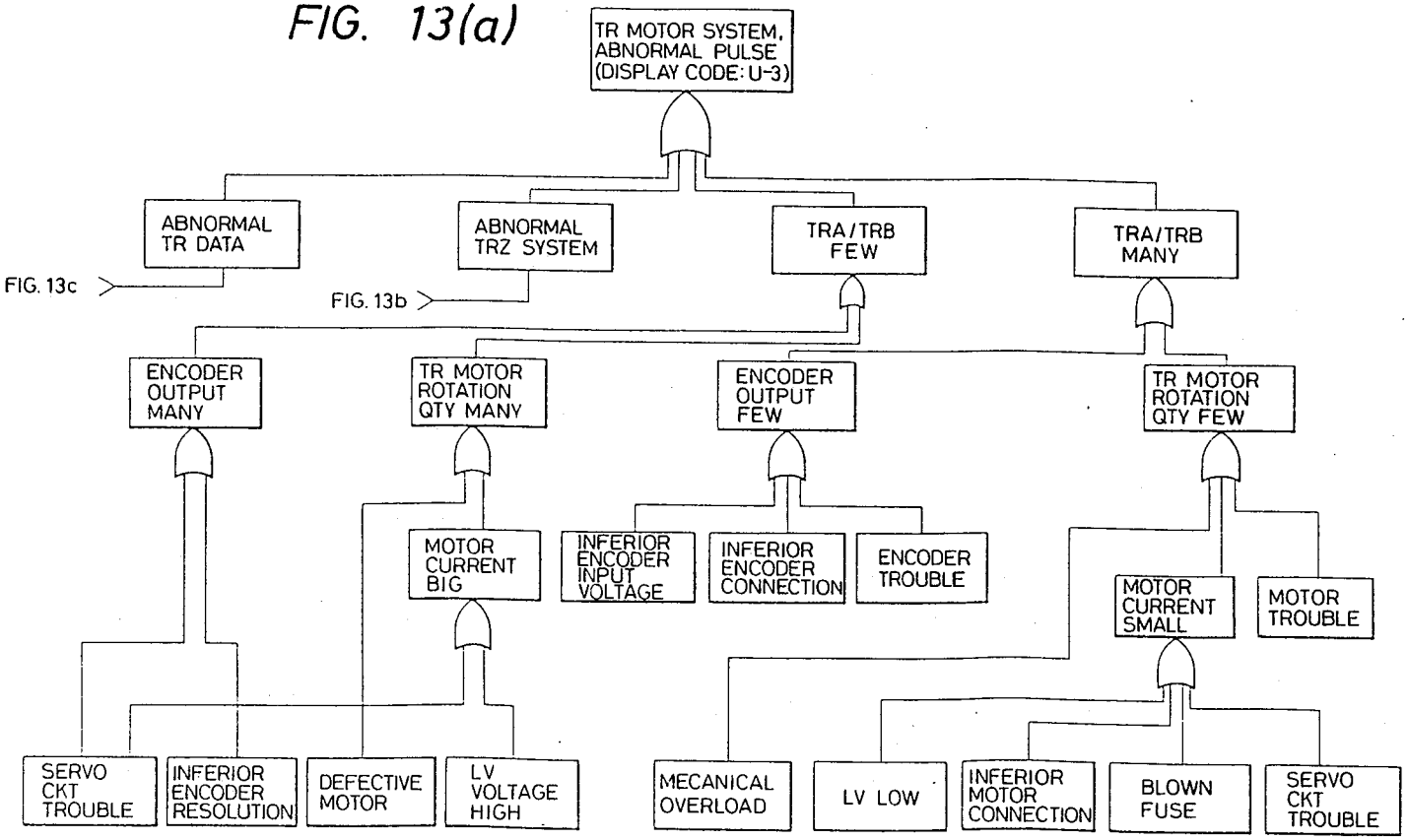
Figure 13B:
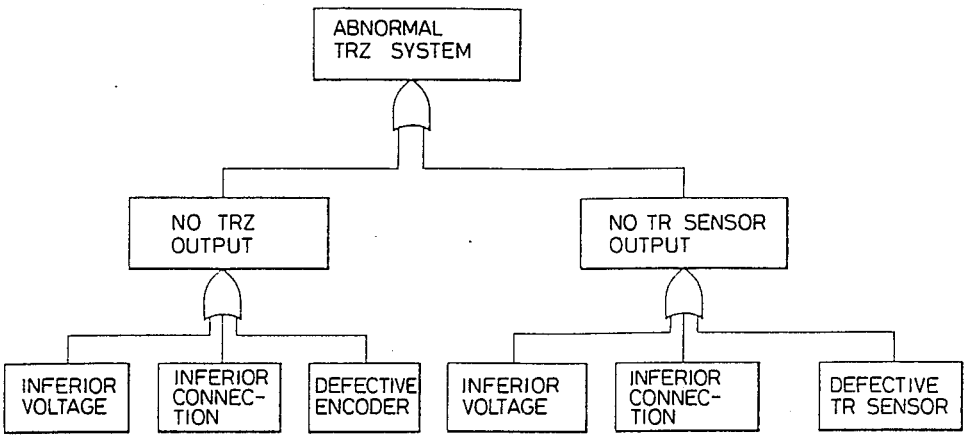
Figure 13C:
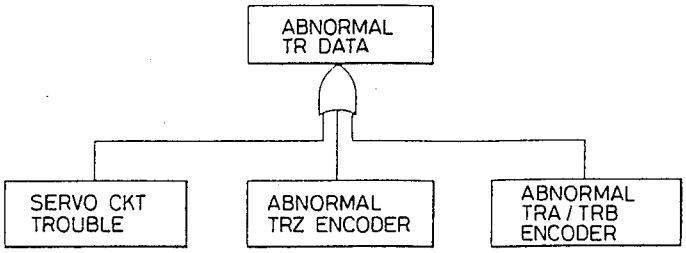

Some of causes for abnormality of the pulse signal system of the PR drum and the TR drum are shown in abnormal condition system drawings shown in FIG. 12 thru FIG. 13.

For example for the system of the PR drum 1, as shown in FIGS. 12(*a*) and (*b*), there are such abnormal phenomena as: poor resolution of the rotary encoder, a defective PR motor 21, rising of DC power supply voltage LV, increase in the number of pulses per rotation of the drum for signals PRA, PRB, and PRZ because of troubles, etc. of the synchronous servo circuit 31, abnormal input voltage and inferior connection of the rotary encoder for the optical sensor, mechanical overload on the rotation mechanism system of the PR motor 21, and decrease in the number of pulses per rotation of the drum due to troubles, of the synchronous servo circuit 31.

Figure 7:
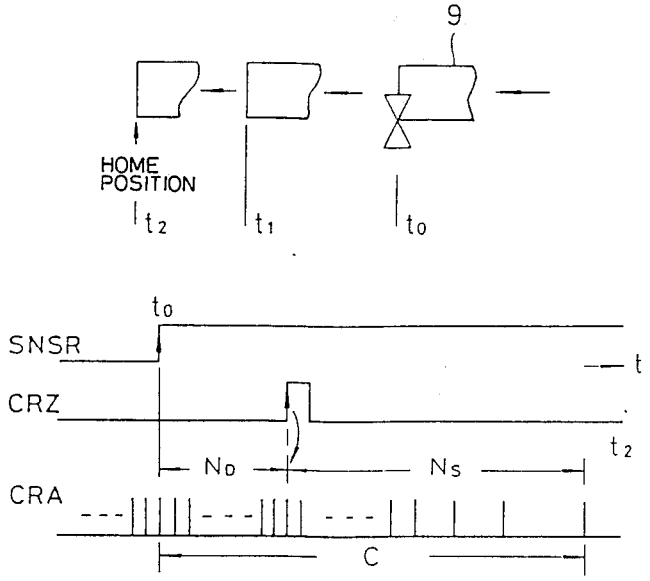
FIG. 7 is a time chart for explaining the origin positioning control for a movable optical system.

Furthermore, for the TR drum 6 system, as shown in FIGS. 13(*a*) through 13(*c*) , there are such abnormal phenomena as: poor resolution of the rotary encoder a defective TR motor 22, rising of DC power supply voltage, increase in the number of pulses per rotation of the drum for signals TRA, TRB and TRZ because of troubles, of the synchronous servo circuit 32, mechanical overload on the TR motor 22, troubles the synchronous servo circuit 32, and decrease in the number of pulses per rotation of the drum due to abnormal voltage and inferior connection of the rotary encoder for the optical sensor. Further, when the movable optical system is stopped at the position "$C-Ns=Nd$" as shown in FIG. 7, it may happen that the optical system 10 and 11 is stopped at a position abnormally close to the stopper side by pas the position of Ns due to mixing of noise or that the movable optical system collides with the stopper. In both cases, the motor is controlled under accelerated condition thereafter, thereby to causing burning of motor windings and driving circuit thereof.

Therefore, in the present embodiment, when the following state arises, it is judged as an abnormal situation, and copying operation is immediately stopped and error codes (for, example, U-1, U-2 and U-3 shown in FIGS. 12 and 13) are displayed at the same time on a display unit (not shown), of the console panel corresponding to the abnormal contents. With such a display a user can easily determine the cause of abnormality, thus enabling him to cope with such an abnormal state correctly.

Figure 14A:
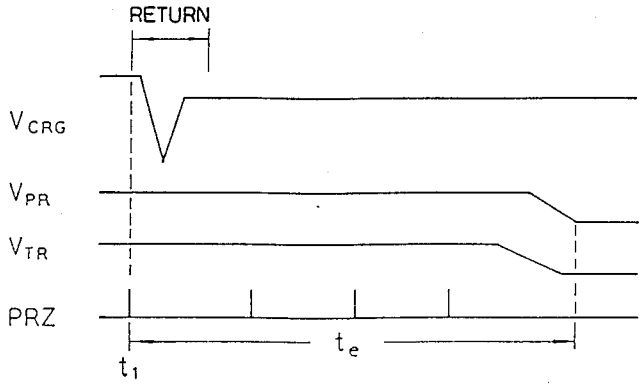
FIGS. 14*a* and 14*b* are a time chart for explaining abnormality detecting operation of the PR motor and the TR motor.
Figure 14B:
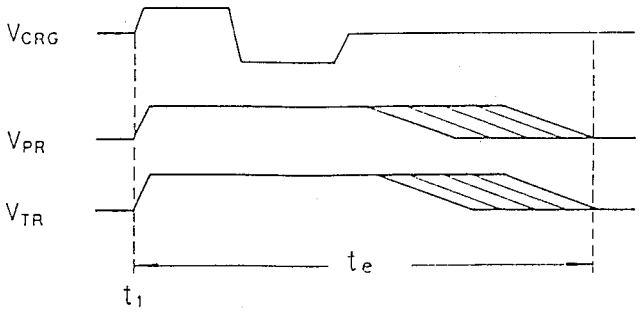

(6-1) When the photoelectric drum 1 or the transfer drum 6 does not stop at the completion point of the copying cycle (a) Normal copying cycle As shown in FIG. 14(*a*), the time te required until the PR motor 21 and the TR motor 22 come to a stop is measured based on the clock signal having a predetermined frequency with the signal PRZ, which is generated in the timing $t_1$ just before the CRG motor 18 switches to the direction of rotation having the movable optical system return to the home position thereof, as the time measurement initiation point. If the time te is, for instance, greater than or equal to 17.2 seconds, it is judged that abnormal matter has occurred in signals PRZ, PRA, TRZ, TRA, etc., There these motors 21, 22 are compulsorily stopped and the copying operation is stopped thereafter.

Such abnormality detection processing is performed whenever a series of copying cycles are completed.

(b) In case of positioning operation

When a diagnosis mode is set by a Control ENable (CE) signal and an origin setting command, by means of one reciprocating motion of the movable optical system 10 and 11 by the CRG motor 18, is input as shown in FIG. 14(*b*), or in case of the origin setting before a series of copying cycles, if the PR motor 21 and the TR motor 22 do not stop within the time Te (approximately 9 sec.) from the scan initiation timing $t_1$, even after the movable optical system has returned to the home position thereof, it is judged that an abnormal situation has occurred in the similar manner as above, and the copying operation is stopped thereafter.

(6-2) Abnormal period of the signal PRZ

Figure 15:
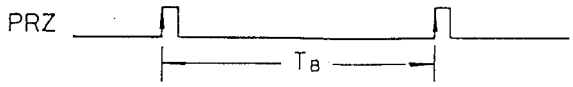
FIG. 15 is a time chart for explaining an abnormality detecting operation of a signal that is synchronous with the rotation of the photosensitive drum.

The signal PRZ is important in setting the latent image forming initiation point IMO accurately. Therefore, as shown in FIG. 15, the length $T_B$ of a period of the signal PRZ is measured based on the clock signal having a predetermined frequency after the PR motor 21 is started. The length $T_B$ is judged abnormal if it does not fall within the range between an upper limit value the lower limit value, and the copying operation is stopped thereafter.

Figure 16:
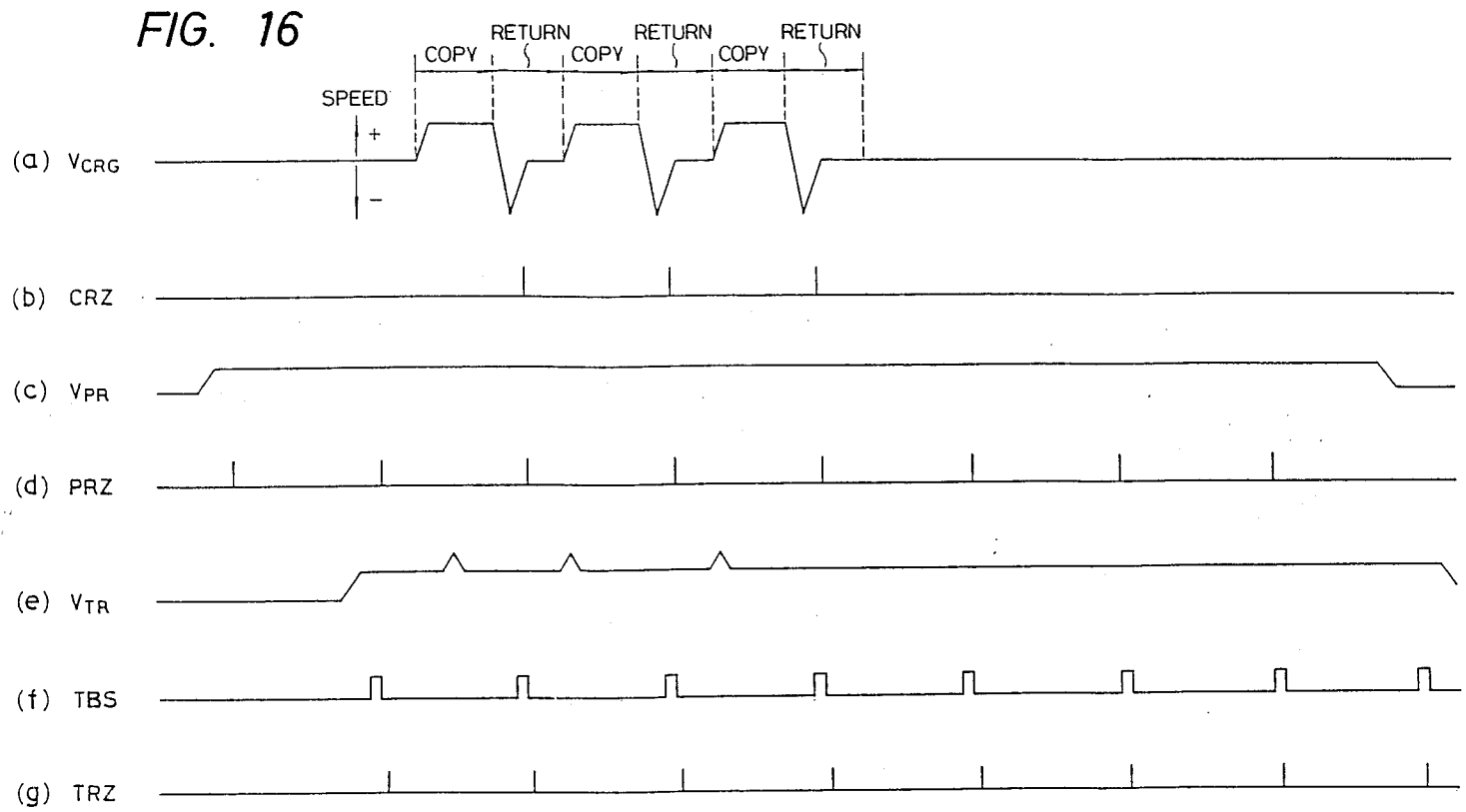
FIG. 16 is a time chart for explaining the operation of a polychromatic copying cycle.

In this case, as shown with the time charts in FIG. 16, the origin position setting control for the photosensitive drum 1 and the transfer drum 6 is performed in advance immediately before the copying cycle in three colors. The signal PRZ that appears first in case of the origin position setting control, is found by measuring the time from the start timing of the PR motor 21 to have a shorter period than that of the signal PRZ, which appears later. Accordingly, judgement of abnormality for this first signal PRZ is made only when the period thereof exceeds the upper limit value.

Figure 17A:
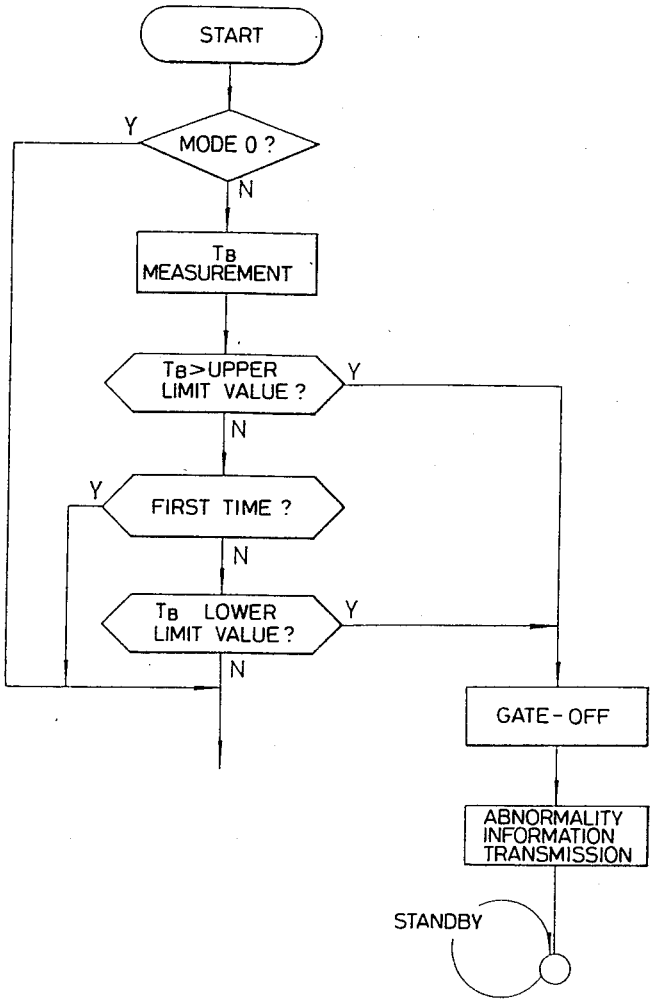
FIGS. 17*a* and 17*b* are a flow chart the abnormality detecting operation shown in FIG. 15.
Figure 17B:
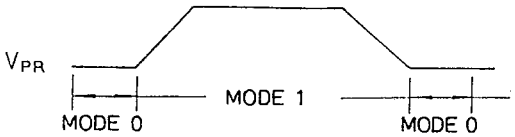

FIG. 17(*a*) is a flow chart sowing the processing of the CPU 334, which detects an abnormal period of said signal PRZ. Here, the "MODE 0" in the first step indicates that the speed of the PR motor 21 is zero as shown in FIG. 17(*b*). The processing shown in the flow chart is executed only for "Mode 1", when the PR motor 21 is under rotating condition. A gate-off signal of the PWM chopper in the synchronous servo circuit 31 is generated if the relationship, the lower limit value $<T_B <$ the upper limit value is not maintained, thereby to stop the rotation of the PR motor 21 immediately and to transmit the information indicating that an abnormal matter has occurred in the signal PRZ to the master controller 24.

(6-3) Abnormal synchronization between TBS and TRZ

Signals TBS and TRZ are important in setting the latent image forming initiation point IMO to the transfer point PO accurately. Abnormality in these signals is caused by abnormality in the encoder and by under-and-over voltage of the motor.

Figure 18:
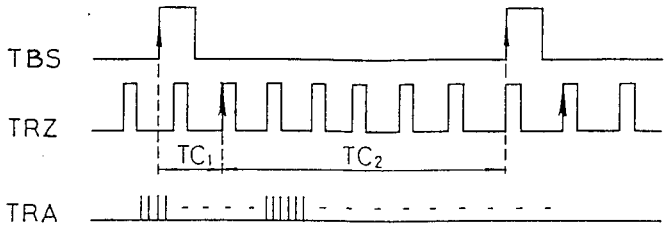
FIG. 18 is a time chart for explaining an abnormality detecting operation for a signal that synchronizes with the rotation of the transfer drum.

Therefore, as shown in FIG. 18, the time interval $TC_1$ between the signal TBS which rises and falls once and the signal TRZ, which appears in the first place immediately after the signal TBS falls, is measured based on the clock signal having a predetermined frequency. If the time interval $TC_1$ is out of the range between the upper limit value and the lower limit value, it is judged that the synchronous relationship between the signal TBS and the signal TRZ is not normal, and the copying operation is stopped thereafter.

Similarly, the time interval $TC_2$ from the signal TRZ to the new signal TBS which appears after $TC_1$, is measured based on abovementioned clock signal, and judgement of abnormality is made if the time interval $TC_2$ does not fall within the range between the upper limit value and the lower limit value.

Figure 19:
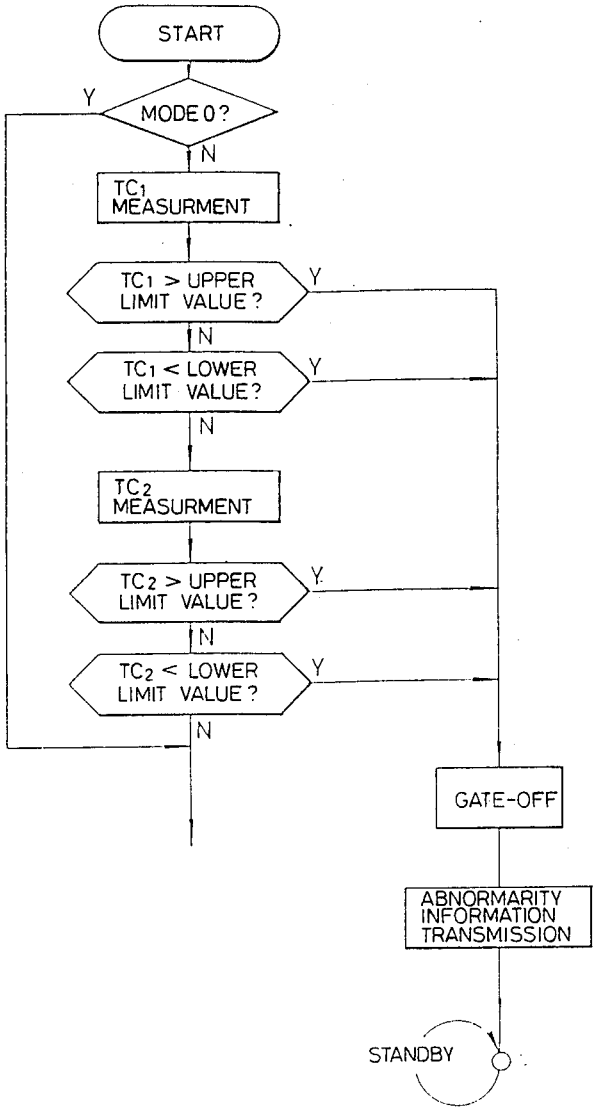
FIG. 19 is a flow chart showing the abnormality detecting operation shown in FIG. 18.

FIG. 19, is a flow chart showing the processing of the CPU 334 for detecting such an abnormal condition. Here, "Mode 0" at the first step indicates that the speed of the TR motor 22 is zero. The processing of this flow chart is executed only in "Mode-1" when the TR motor 22 is Then $TC_1$ and $TC_2$ are abnormal, the gate-off signal of the PWM chopper in the synchronous servo circuit 32 is generated, thereby stopping the rotation of the TR motor 22 immediately transmit transmitting the information indicating abnormal synchronization between signals TBS and TRZ to the master controller 24.

(6-4) Locking of the TR motor

Figure 20:
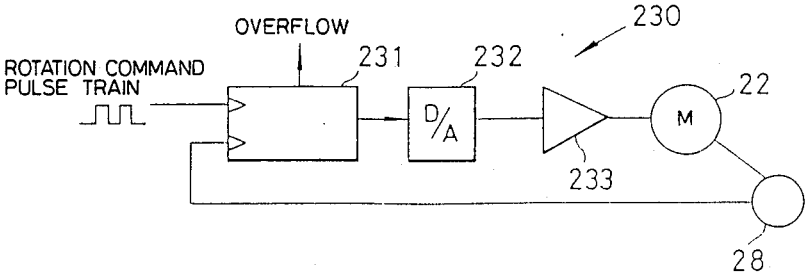
FIG. 20 is a circuit diagram showing the structure of a synchronous compensator of the motor.

Acceleration/deceleration control is performed on abovementioned CRG motor, PR motor 21, and TR motor 18 22 by adjusting the motor current with a synchronous compensator 230, such as shown in FIG. 20 provided in the servo controller 23. When a command pulse train from the control circuit 33 corresponding to the target value of the rotation speed is input, an up-down counter 231 up-counts this command pulse train. If the count value of the counter 231 is increased, the output voltage of a DA converter 232 which converts the count value of said counter 231 into an analog voltage, is also increased. Since the output voltage of the DA converter 232 is applied to, for example, the TR motor. 22 through an amplifier 233, the TR motor 22 is started and is then accelerated When the TR motor 22 is started, the signal TRA (TRB) is generated from a pulse generator 28 coupled to the rotation shaft thereof. Since this signal TRA is input to the down-count input of the up down-counter 231, the count value of the counter 231 becomes zero when the rotation quantity of the TR motor 22 reaches the rotation quantity corresponding to the command pulse train, thereby stopping the TR motor 22.

In the servo controller 23, the rotation of each motor is made to reach the target value by means of such synchronous compensator, but a gripper 17 for gripping the transfer paper is mounted on the circumferential surface of the transfer drum 6, and a release cam (not shown) for releasing the transfer paper completed with transference is also provided, as it were, seeing the circumferential surface. Accordingly, when the gripper 17 and the release cam engage each other for some reason, or the gripper 17 engages another protruding portion of the frame, the rotation of the TR motor 22 is brought under locked condition. Thus, since the signal TRA or TRB is not output, the count value of the up-down counter 231 is no longer reduced and the voltage applied to the TR motor 22 continues the acceleration condition, thus causing troubles such as burning of windings and driving circuits thereof.

Figure 21:
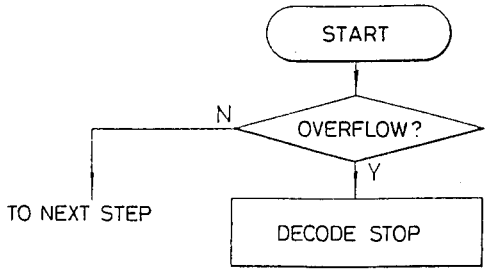
FIG. 21 is a time chart for explaining a abnormality detecting operation when the motor is mechanically locked.

Therefore, in the present embodiment, as shown by the flow chart shown in FIG. 21, when the next command pulse train is input to the counter 231 under such a condition that the TR motor 22 is mechanically locked, the voltage to the TR motor 22 is immediately isolated when an overflow output is produced, utilizing the fact that said counter 231 overflows immediately, and the copying operation thereafter is made to stop at the same time.

Thus it is possible to prevent troubles such as burning of the TR motor 22 and the driving circuit thereof.

(7) Abnormal stop position of the movable optical system

As described above, when the movable optical system 10 and 11 is stopped at the position "$C-N_S=N_d$" shown in FIG. 7, the optical system passes the position of $N_S$ and is stopped at a position abnormally close to the stopper side or when the movable optical system 10 and 11 collides with the stopper due to mixing of noise, the motor as the power source continues to be controlled under , accelerated condition thereafter, thus causing possible burning of motor windings and driving circuits thereof.

Accordingly, in the present embodiment, measuring means for measuring the distance to the stop position of the movable optical system by counting pulse signals CRA and CRB after the REG sensor 29 is operated are provided in the CPU 334 of the control circuit 33. Here, since measuring means differ in phase by 90 degrees from that of pulse signals CRA and CRB, the moving direction is determined depending on which phase is leading. If the optical system is moving toward the stop position, the distance to the stop position is measured by counting pulse signals CRA or CRB with the operating timing of the REG sensor 29 as the starting point of measurement. Then, the measured value is stored until the next measuring time.

The CPU 334 reads the measured value of the measuring means when the power supply of the relevant copying machine is connected, immediately before copying initiation for the first sheet, or immediately before shifting to a series of copying cycles, and compares the measured value with a predetermined value.

Figure 22:
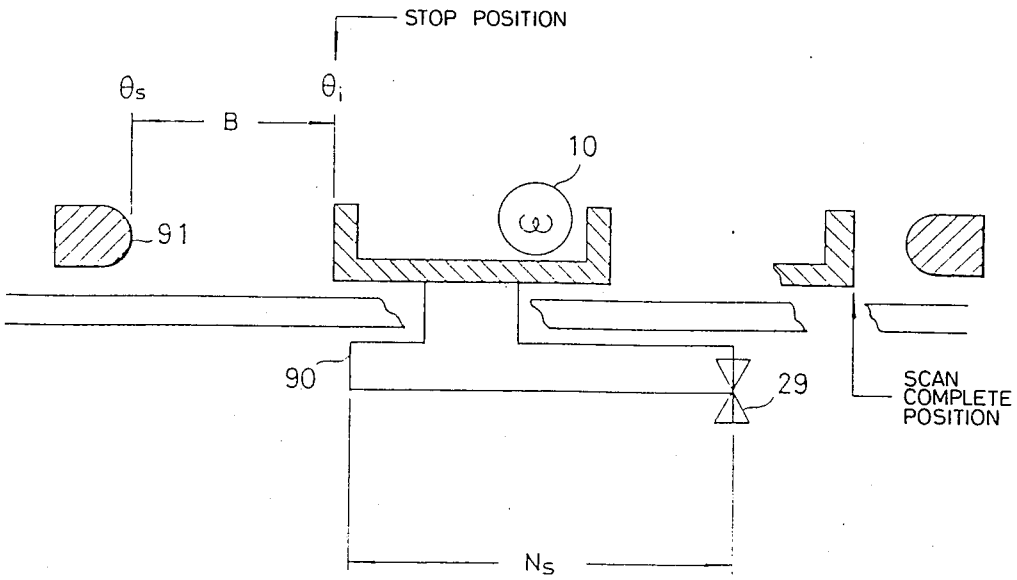
FIG. 22 is a sectional view showing the positional relationship between an optical scanning mechanism and a stopper.

For instance, the distance B between an actuator 90 supporting the movable optical system 10 and 11 and a stopper 91 may be for example, B=5 mm as shown in FIG. 22 at the normal stop position. When the actuator 90 returns from the scan complete position to the stop position, the position control of the movable optical system 10 and 11 is performed by the CPU 334 so that the optical system movable optical system 10 and 11 stops at a distance, after advancing by $N_S$ so that B=5 mm after the REG sensor 29 is operated.

However, if a mistake in reading the pulse signal CRA or CRB or a noise, etc. occurs, the CRG motor 18 is still controlled under accelerated condition even after the movable optical system 10 and 11 has passed the normal stop position and collided with the stopper 91. Therefore, the CPU 334 reads the measured value $\theta_i$ of measuring means immediately before a series of copying cycles, and compared to determine whether the absolute value of the difference from the position $\theta_S$ of the stopper 91 $|\theta_i-\theta_s|$ is, for example, at 3.5 mm If the different is 3.5 mm, it is judged that abnormal matter has occurred in CRB generating mechanism or reading mechanism, etc., and simultaneously with stopping the copying operation thereafter an abnormality message is displayed to advise such situation of the CE.

Such an arrangement permits, serious troubles, such as the burning of motor windings and driving circuits thereof, from occurring. Such measurement is executed every predetermined time such as when the power supply of the relevant copying machine is connected, immediately before the initiation of copying of the first sheet or immediately before shifting to a series of copying cycles.

(8) Copying mode and diagnosis mode

The abovementioned positioning control and abnormality processing are executed by means of the servo controller 23.

Accordingly, the diagnosis becomes difficult when an abnormal matter occurs in any of the servo loops for 3 sets of motors in total. Therefore, in the present embodiment the diagnosis mode and the copying mode are provided in the master controller 24 and, by selecting the diagnosis mode and giving a command for diagnosis, the servo controller 23 is made to execute the operation responding to said command for diagnosis, thereby enabling diagnosis of the results.

Figure 23:
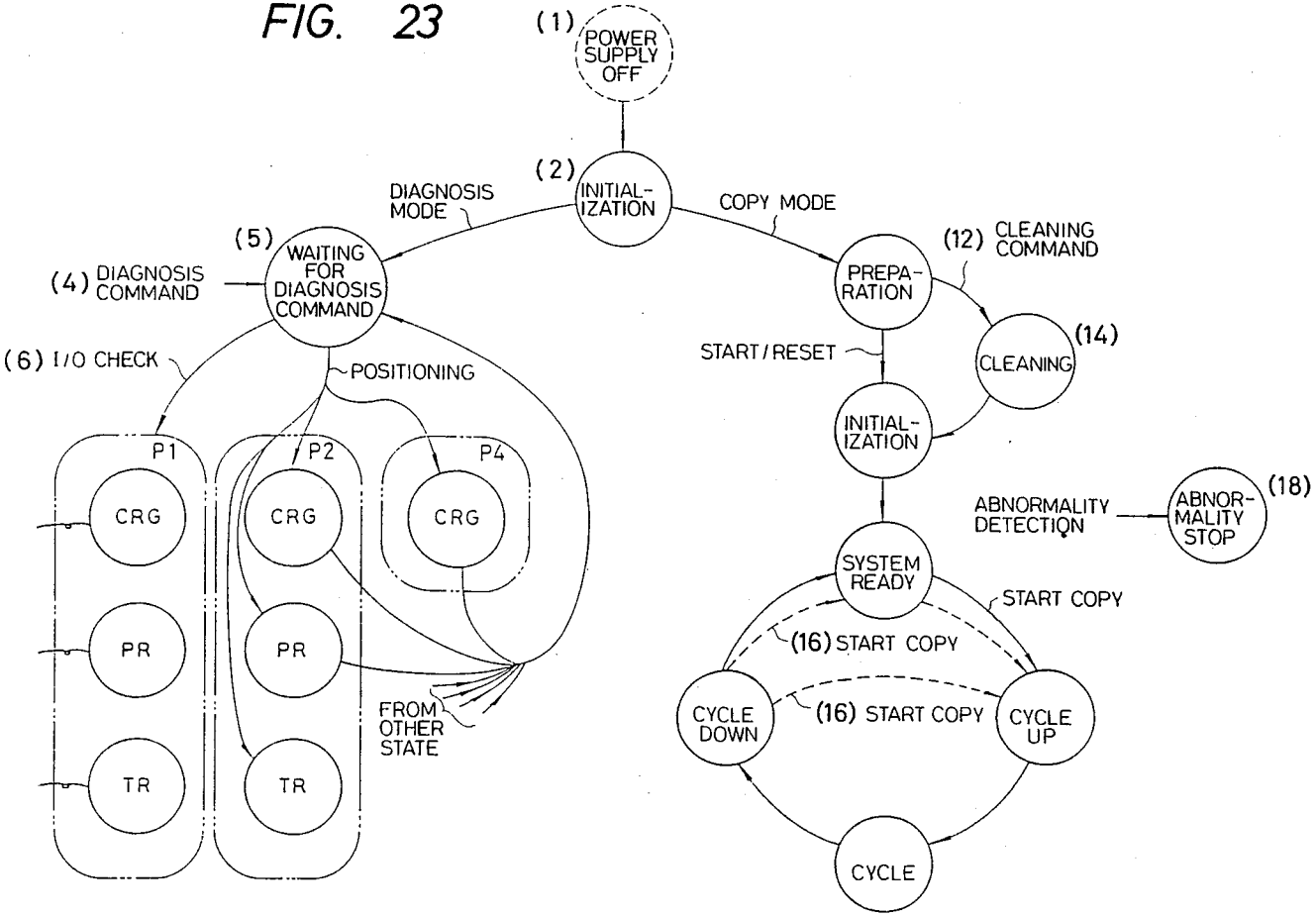
FIG. 23 is a state transition drawing showing the state transition in a copying mode and a diagnosis mode.
Figure 24:
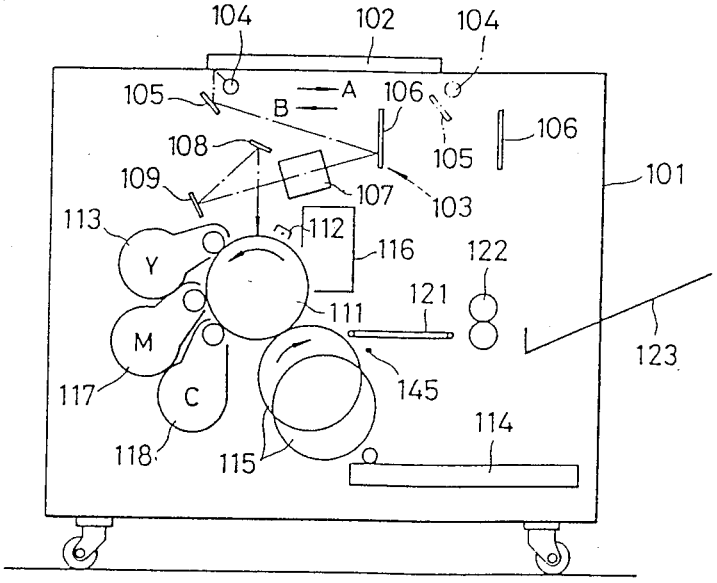
FIG. 24 PRIOR ART
FIG. 24 is a schematic block diagram showing the structure of a conventional copying machine.
Figure 25:
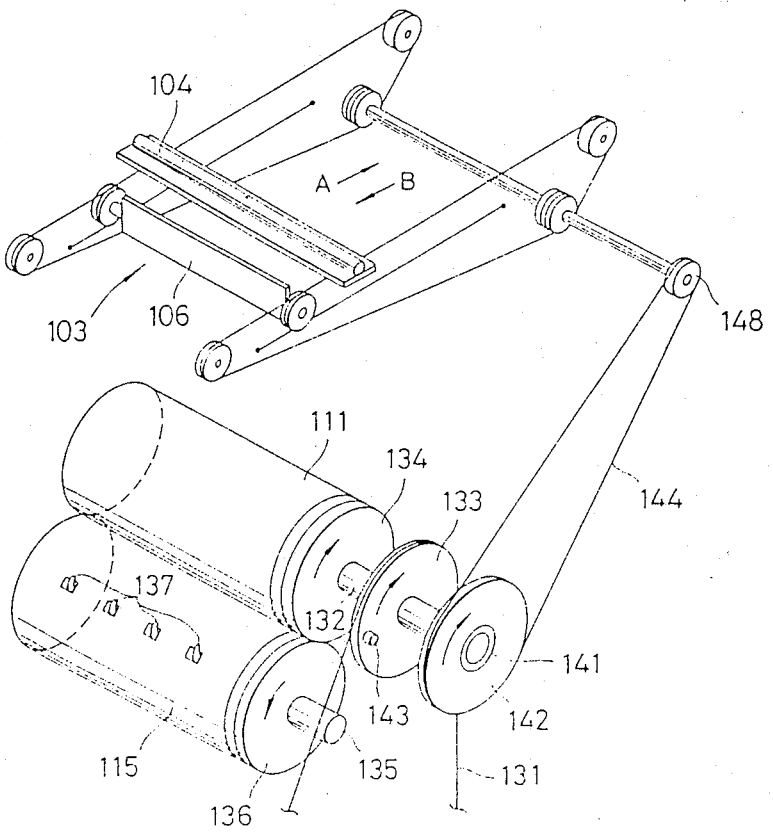
FIG. 25 PRIOR ART
FIG. 25 is a perspective view showing the structure of a movable portion positioning control mechanism in a conventional copying machine.

FIG. 23 is a state transition drawing showing the transition of the operation state in the present embodiment. The right site thereof shows the state transition in the copy mode and the left side thereof shows the state transition in the diagnosis mode both after the initializing state.

In the copying mode, the state is under preparation state until completion of preparation such that the temperature of the fixing unit reaches a predetermined temperature, but, when the preparation state is over, cleaning of the photosensitive drum and system initializing are performed. Thereafter, the state of every servo loop is read by the master controller 24 through the serial data line 25. In case of a normal state, a system ready state is created and copying cycles by every color are performed in consecutive order by means of input of the copy start command. When the copying operation for all colors is completed, the cycle comes to the end and returns to the system ready state. However, if there is an abnormal matter in any of servo loops, the abnormality stop state is produced by means of abnormality detection signal generated for the above.

On the other hand, in the diagnosis mode, the unit is in the standby state waiting for the diagnosis command. When the diagnosis command for positioning the CRG motor 18, the PR motor 21, the TR motor 22 and the movable optical system 10 and 11 is input, a positioning operation is performed based on the input diagnosis command. Further, when a diagnosis command for the pulse generator, such as a command effecting a rotary encoder or the sensor, is input, the relevant motor is made to rotate and the servo controller 23 is made to perform diagnosis on correctness or incorrectness of the signal of the pulse generator, etc., which is coupled to the motor, and to transmit the information on the result of diagnosis to the master controller 24.

For example, in the $P_1$ mode wherein diagnosis is made on the I/O signal with the pulse generator, etc. of each drum, the movable optical system, the PR drum 1 and the TR drum 6 are rotated, rising and trailing timings of output signals SNSR and PRZ of the REG sensor 29 and the output signal TBS of the TR sensor 60 are detected, and the detected information is transmitted to the master controller 24 at that time. Furthermore, in $P_2$ and $P_4$ modes, wherein diagnosis is made on the rotating state and positioning operation of the movable optical system, the PR drum 1 and the TR drum 6, the positioning operation ($P_4$ mode) is continued until the stop command or the emergency stop command is input from the console panel. Moreover, the PR drum 1 and the TR drum 6 are also operated until the stop command or the emergency stop command is input from the console panel.

Thus, it is possible to execute diagnosis of the whole unit and tracking of the trouble portion when an abnormal matter occurs only by the input operation of the diagnosis command from the console panel without employing any special measuring unit.

Besides, with the copying machine of the present, embodiment, copying with an enlargement ratio can be had by adjusting the moving speed of the movable optical system to be relatively slower than the rotation speed of the photosensitive drum and the transfer drum, and in the reverse case, copying with a reduction ratio is possible.

As described above, according to the present invention, there is provided measuring means for measuring the time interval of the reference signal generated synchronously with the rotation of the photosensitive substance. The copying operation is stopped forcibly when the time interval measured by this measuring means is out of the specified range. Accordingly, it is possible to prevent troubles such as burning of a motor from occurring and to make the maintenance operation easy thereafter.

According to the present invention, there are provided switching means disposed at a predetermined distance from the stop position of the optical scanning mechanism toward the scanning direction of the manuscript picture image, that is operated every time said optical scanning mechanism reciprocates for the purpose of scanning for reading the manuscript picture image, reference signal generating means that is coupled with the rotation shaft of a motor for driving said optical scanning mechanism and generates a reference signal between the operating position of said switching means and said stop position, pulse generating means that is coupled with the rotation shaft of the motor for driving said optical scanning mechanism, and generates pulses at every predetermined rotation angle, measuring means for measuring the time interval from the operation timing of said switching means to the generation timing of said reference signal by counting said pulses, and control means for executing emergency shut down of the copying operation when a measured value of said measuring means does not fall within a predetermined range at the starting time of said optical scanning mechanism. Therefore, it is possible to prevent troubles such as burning of the motor for moving the movable optical system from occurring, and also to aim at the reduction of the maintenance cost.

As described above, in the present device, there are provided reference signal generating means for generating a reference signal which is employed as the reference for the transfer initiating position of an electrostatic latent image synchronously with the rotation of transfer means, pulse generating means for generating a pulse signal which corresponds to the grip timing of a transfer paper synchronously with the rotation of abovesaid transfer means, measuring means for measuring the synchronous relationship between said reference signal and said pulse signal and the time interval of said reference signal, and control means which discriminates whether measured synchronous relationship and time interval fall within the specified range or not, and when those are out of the specified range, stops the copying operation. Accordingly, it is possible to obtain a copied picture image which is faithful to the original picture image and to prevent troubles such as burning of motors from occurring.

According to the present invention, a described above, there are provided switching means that is disposed at a predetermined distance from the stop position of the optical scanning mechanism toward the scanning direction of the manuscript picture image, and is operated every time said optical scanning mechanism reciprocates for the purpose of scanning for reading the manuscript picture image, reference signal generating means that is coupled with the rotation shaft of a motor for driving the optical scanning mechanism, and generates a reference signal between the operating position of said switching means and said stop position, pulse generating means that is coupled with the rotation shaft of the motor for driving the optical scanning mechanism, and generates pulses at every predetermined rotation angle, measuring means for measuring the time interval from the operation timing of said switching means to the generation timing of said reference signal by counting said pulses, and control means for controlling the stop position of the optical scanning mechanism based on the measured value of said measuring means. Therefore, it is possible to obtain good picture quality having neither color shear nor positional dislocation even if there is any state variation in the motive power conveying mechanism such as belt that moves the optical system.

According to the present invention, as described above, there is provided control means for controlling the positional relationship between the photosensitive substance and the transfer means with a predetermined relationship before initiation or after the termination of the copying cycle. Therefore, it is possible to keep the starting positional relationship between the photosensitive substance and the transfer drum always under normal relationship, thereby to prevent deletion from occurring at the time of transfer.

According to the present invention, there are provided pulse generating means for generating a pulse signal synchronizing with the rotation of the transfer means, timing pulse generating means for generating timing pulses which represent the grip timing for a transfer paper synchronously with the rotation of said transfer means, and control means which counts said pulse signals after said timing signal is generated, and controls the transfer operation by recognizing the time when the count value reaches a predetermined value as the reference point for the transfer initiation point. Thus, it is possible to have the latent image forming initiation point and the transfer initiation point coincide with each other with high accuracy.

According to the present device, there are provided pulse generating means for generating a pulse signal having a predetermined frequency, counting means for counting pulse signals generated by said pulse generating means from the picture image scanning termination point of said optical scanning mechanism, and control means for shutting down emergently the copying operation when said copying operation is not terminated when the counted value reaches a predetermined value. Thus, it is possible to prevent troubles such as burning of a motor from occurring and to make the maintenance operation easy thereafter.

According to the present device, as described above, there is provided control means which stops the copying operation when an overflow output is generated from the counter means which rotates the transfer means in accordance with the difference between the pulse train corresponding to the target value of the rotation quantity of the transfer means and the pulse signal which synchronizes with the rotation.

According to the present invention, there are provided reference signal generating means for generating a reference signal which is used as the reference for the forming initiation position of the electrostatic latent image synchronously with the rotation of the photosensitive substance, and control means for having the optical scanning mechanism start when the rotation angle of the photosensitive substance reaches a predetermined angle based on the reference signal generated from the reference signal generating means. Thus, it is possible to keep the synchronous relationship of the start timing between the photosensitive substance and the optical scanning mechanism with a relationship fixed at all times.

According to the present invention, as described above, the control time of acceleration or deceleration by the transfer means is limited to the interval until the point of the transfer paper reaches the transfer point after the transfer paper is gripped. Accordingly, it is possible to perform acceleration/deceleration control of the transfer drum without causing misgripping.

According to the present invention, as described above, there are provided, in the control means for controlling respective means such as transfer means, a copy mode for controlling a series of copying processes by controlling abovementioned respective means, and a diagnosis mode for making a diagnosis of abovementioned respective means. Therefore, it is possible to easily make a diagnosis of abnormality existing in means for controlling each portion of a copying machine.

What is claimed is:

1. A control unit for controlling a copying machine, comprising:

an optical scanning mechanism for scanning a manuscript surface having a picture image;

a photosensitive substance rotating synchronously with the scanning operation of said optical scanning mechanism, on which an electrostatic latent image corresponding to said picture image is formed;

developing means for developing said electrostatic latent image;

transfer means for transferring an image developed through said developing means to a recording paper, said transfer means including a gripper for gripping said recording paper and a sensor for detecting an operational state of said gripper and outputting a detecting signal, wherein said transfer means substantially limits a time of the reception of a first, a second, and a third signal according to the detection signal from said sensor;

first means for generating said first signal indicating a position of said optical scanning mechanism within a moving range thereof;

second means for generating said second signal indicating an amount of movement of said photosensitive substance;

third means for generating said third signal indicating an amount of movement of said transfer means; and control means connected to said optical scanning mechanism, said photosensitive substance, and said transfer means for controlling, according to one of said first, second, and third signals, the position of said optical scanning mechanism, said photosensitive substance, and said transfer means.

2. A control unit for controlling a copying machine, comprising:

an optical scanning mechanism for scanning a manuscript surface having a picture image;

a photosensitive substance rotating synchronously with the scanning operation of said optical scanning mechanism, on which an electrostatic latent image corresponding to said picture image is formed;

developing means for developing said electrostatic latent image;

transfer means for transferring an image developed through said developing means to a recording paper, said transfer means including a gripper for gripping said recording paper and a sensor for detecting an operational state of said gripper and outputting a detecting signal, wherein said transfer means substantially limits a time of the reception of a first, a second, and a third signal according to the detection signal from said sensor;

first means for generating said first signal indicating a position of said optical scanning mechanism within a moving range thereof;

second means for generating said second signal indicating an amount of movement of said photosensitive substance;

third means for generating said third signal indicating an amount of movement of said transfer means;

first control means connected to said optical scanning mechanism, said photosensitive substance, and said transfer means for controlling, according to one of said first, second, and third signals, the position of said optical scanning mechanism, said photosensitive substance, and said transfer means;

pulse generating means for generating a pulse signal corresponding to a grip timing of said recording paper synchronously with the rotation of said transfer means;

measuring means for measuring the synchronous relationship between said third signal and said pulse signal and the time interval of said third signal; and second control means for discriminating whether the measured synchronous relationship and time interval fall within a predetermined range, and for stopping the copying operation when the measured relationship and time interval are out of the predetermined range.

3. A control unit for controlling a copying machine, comprising:

an optical scanning mechanism for scanning a manuscript surface having a picture image;

a photosensitive substance rotating synchronously with the scanning operation of said optical scanning mechanism, on which an electrostatic latent image corresponding to said picture image is formed;

developing means for developing said electrostatic latent image;

transfer means for transferring an image developed through said developing means to a recording paper, said transfer means including a gripper for gripping said recording paper and a sensor for detecting an operational state of said gripper and outputting a detecting signal, wherein said transfer means substantially limits a time of the reception of a fruit, a second, and a third signal according to the detecting signal from said sensor;

first means for generating said first signal indicating a position of said optical scanning mechanism within a moving range thereof;

second means for generating said second signal indicating an amount of movement of said photosensitive substance;

third means for generating said third signal indicating an amount of movement of said transfer means;

first control means connected to said optical scanning mechanism, said photosensitive substance, and said transfer means for controlling, according to one of said first, second, and third signals, the position of said optical scanning mechanism, said photosensitive substance, and said transfer means; and second control means for controlling a positional relationship between said photosensitive substance and said transfer means with a predetermined relationship by employing said second and third signals and said detecting signal.

4. A control unit for controlling a copying machine, comprising:

an optical scanning mechanism for scanning a manuscript surface having a picture image;

a photosensitive substance rotating synchronously with the scanning operation of said optical scanning mechanism, on which an electrostatic latent image corresponding to said picture image is formed;

developing means for developing said electrostatic latent image;

transfer means for transferring an image developed through said developing means to a recording paper, said transfer means including a gripper for gripping said recording paper and a sensor for detecting an operational state of said gripper and outputting a detecting signal, wherein said transfer means substantially limits a time of the reception of a first, a second, and a third signal according to the detection signal from said sensor;

first means for generating said first signal indicating a position of said optical scanning mechanism within a moving range thereof;

second means for generating said second signal indicating an amount of movement of said photosensitive substance;

third means for generating said third signal indicating an amount of movement of said transfer means;

first control means connected to said optical scanning mechanism, said photosensitive substance, and said transfer means for controlling, according to one of said first, second, and third signals, the position of said optical scanning mechanism, said photosensitive substance, and said transfer means; and second control means for controlling a positional relationship between said photosensitive substance and said transfer means with a predetermined relationship by employing said second and third signals and said detecting signal after the termination of a reciprocating motion consisting of a double stroke of the optical scanning mechanism.

5. A control unit for controlling a copying machine, comprising:

an optical scanning mechanism for scanning a manuscript surface having a picture image;

a photosensitive substance rotating synchronously with the scanning operation of said optical scanning mechanism, on which an electrostatic latent image corresponding to said picture image is formed;

developing means for developing said electrostatic latent image;

transfer means for transferring an image developed through said developing means to a recording paper, said transfer means including a gripper for gripping said recording paper and a sensor for detecting an operational state of said gripper and outputting a detecting signal, wherein said transfer means substantially limits a time of the reception of a first, a second, and a third signal according to the detection signal from said sensor;

first means for generating said first signal indicating a position of said optical scanning mechanism within a moving range thereof;

second means for generating said second signal indicating an amount of movement of said photosensitive substance;

third means for generating said third signal indicating an amount of movement of said transfer means;

first control means connected to said optical scanning mechanism, said photosensitive substance, and said transfer means for controlling, according to one of said first, second, and third signals, the position of said optical scanning mechanism, said photosensitive substance, and said transfer means; and second control means for controlling a positional relationship between said photosensitive substance and said transfer means with a predetermined relationship by employing said second and third signals and said detecting signal before initiation of a copying cycle.

* * * * *

UNITED STATES PATENT AND TRADEMARK OFFICE

CERTIFICATE OF CORRECTION

PATENT NO. : 4,975,741

DATED : December 04, 1990

INVENTOR(S) : Masaaki Tanaka

It is certified that error appears in the above-identified patent and that said Letters Patent is hereby corrected as shown below:

Abstract, Line 22, change "sychronously" to --synchronously--;

Drawings, Fig. 3, change "PRC" to --PRA--;

Column 1, Line 40, after "image," insert --and--;

Column 1, Line 45, after "words" insert --,--;

Column 1, Line 65, change ":n" to --in--;

Column 2, Line 19, change " a round" to --around--;

Column 2, Line 42, after "Next" insert --,--;

Column 2, Line 48, change "operation" to --operations--;

Column 2, Line 53, after "shown)" insert --is--;

UNITED STATES PATENT AND TRADEMARK OFFICE

CERTIFICATE OF CORRECTION

PATENT NO. : 4,975,741

DATED : December 04, 1990

INVENTOR(S) : Masaaki Tanaka

It is certified that error appears in the above-identified patent and that said Letters Patent is hereby corrected as shown below:

Column 2, Line 57, change "135 reference numeral" to --reference numeral 135--;

Column 3, Line 21, before "104" insert --lamp--;

Column 3, Lines 31 & 32, change "a round" to --around--;

Column 3, Line 39, after "result" change "," to --.--;

Column 4, Line 6, change "aimed at" to --achieved--;

Column 5, Line 1, change "cf" to --of--;

Column 5, Line 12, after "each" change "another" to --other--;

Column 5, Line 12, after "with" change "other" to --another--;

UNITED STATES PATENT AND TRADEMARK OFFICE

CERTIFICATE OF CORRECTION

PATENT NO. : 4,975,741

DATED : December 04, 1990

INVENTOR(S) : Masaaki Tanaka

It is certified that error appears in the above-identified patent and that said Letters Patent is hereby corrected as shown below:

Column 5, Line 18, change "and," to --, and--;

Column 5, Line 23, after "configuration" delete [, it];

Column 5, Line 45, change "time" to --times--;

Column 6, Line 50, before "quality" delete [of];

Column 7, Line 64, change "i.e." to --,i.e.,--;

Column 8, Lines 29 & 30, change "emergence" to --emergency shutdown--;

Column 10, Line 45, after "shade" insert --.--;

Column 11, Line 8, change "FIG." to --FIGS.--;

Column 11, Line 8, change "diagram" to --diagrams--;

UNITED STATES PATENT AND TRADEMARK OFFICE

CERTIFICATE OF CORRECTION

PATENT NO. : 4,975,741

DATED : December 04, 1990

INVENTOR(S) : Masaaki Tanaka

It is certified that error appears in the above-identified patent and that said Letters Patent is hereby corrected as shown below:

Column 11, Line 27, change "a time chart" to --time charts--;

Column 11, line 35, after "chart" insert --showing--;

Column 11, Line 44, change "a" to --an-- {second occurence};

Column 12, Line 3, change "Reference" to --reference--;

Column 12, Line 15, after "drum" insert --1--;

Column 12, Line 23, after "13" insert --,--;

Column 12, Line 47, after "L" insert --,--;

Column 12, Line 49, after "position" insert --,--;

Column 12, Line 58, change "a round" to --around--;

UNITED STATES PATENT AND TRADEMARK OFFICE

CERTIFICATE OF CORRECTION

PATENT NO. : 4,975,741

DATED : December 04, 1990

INVENTOR(S) : Masaaki Tanaka

It is certified that error appears in the above-identified patent and that said Letters Patent is hereby corrected as shown below:

Column 13, Line 5, after "green" insert --,--;

Column 13, Line 12, change "5y" to --5Y--;

Column 13, Line 21, after "color" delete [,] {first occurence};

Column 13, Line 21, after "color" insert --,-- {second occurence};

Column 13, Line 48, after "process" insert --and--;

Column 13, Line 63, change "23" to --24--;

Column 14, Line 3, change "23" to --21--;

Column 14, Line 6, change "o" to --of--;

Column 14, Line 17, after "3" insert --,--;

UNITED STATES PATENT AND TRADEMARK OFFICE

CERTIFICATE OF CORRECTION

PATENT NO. : 4,975,741

DATED : December 04, 1990

INVENTOR(S) : Masaaki Tanaka

It is certified that error appears in the above-identified patent and that said Letters Patent is hereby corrected as shown below:

Column 16, Line 66, after "input" insert --signals,--;

Column 16, line 68, after "started" insert --to--;

Column 17, Line 12, after "amplifier" insert --306--;

Column 17, Line 26, after "Therefore" insert --,--;

Column 17, Line 46, change "as as" to --as--;

Column 17, line 48, change "θTR" to --θTR--;

Column 17, Line 49, change "$_p$R" to --PR--;

Column 17, Line 49, change "an" to --and--;

Column 17, Line 64, change "timing" to --time--;

Column 17, Line 66, change "TRS" to --TBS--;

UNITED STATES PATENT AND TRADEMARK OFFICE

CERTIFICATE OF CORRECTION

PATENT NO. : 4,975,741

DATED : December 04, 1990

INVENTOR(S) : Masaaki Tanaka

It is certified that error appears in the above-identified patent and that said Letters Patent is hereby corrected as shown below:

Column 17, Line 68, change "VPR" to --$V_{PR}$--;

Column 18, Line 6, change "TRS" to --TBS--;

Column 18, Line 11, change "TRS" to --TBS--;

Column 18, Line 22, change "to forming of" to --forming--;

Column 19, Line 1, after "Furthermore" insert --,--;

Column 19, Line 18, change "After" to --after--;

Column 19, Line 58, after "TR" delete [,];

Column 20, Lines 12 & 13, change ", before" to --before--;

Column 20, Line 18, after "after" insert --removal of--;

UNITED STATES PATENT AND TRADEMARK OFFICE

CERTIFICATE OF CORRECTION

PATENT NO. : 4,975,741

DATED : December 04, 1990

INVENTOR(S) : Masaaki Tanaka

It is certified that error appears in the above-identified patent and that said Letters Patent is hereby corrected as shown below:

Column 22, Line 34, after "thereby" delete [to];

Column 22, Line 39, after "for" delete [,];

Column 22, Line 42, after "display" insert --,--;

Column 22, Line 59, change ",There" to --Therefore,--;

Column 22, Line 65, change "ENable" to --Enable--;

Column 23, Line 23, after "first" insert --,--;

Column 23, Line 27, before "judgement" insert --a--;

Column 23, Line 30, change "sowing" to --showing--;

Column 23, Line 63, after "and" insert --a--;

Column 23, Line 67, after "19" delete [,];

Column 24, Line 4, after "is" insert --rotating.--;

UNITED STATES PATENT AND TRADEMARK OFFICE

CERTIFICATE OF CORRECTION

PATENT NO. : 4,975,741

DATED : December 04, 1990

INVENTOR(S) : Masaaki Tanaka

It is certified that error appears in the above-identified patent and that said Letters Patent is hereby corrected as shown below:

Column 24, Line 7, change "transmit" to --and--;

Column 24, Line 12, after "CRG motor" insert --18--;

Column 24, Line 13, before "22" delete [18];

Column 24, Line 24, after "motor" delete [.];

Column 24, Line 25, after "accelerated" insert --.--;

Column 24, Line 60, after "Thus" insert --,--;

Column 24, Line 65, change "$N_d$ to --$N_D$--;

Column 19, Line 17, change "NS=C-ND" to $N_S$=C-$N_D$--;

Column 19, Line 27, change "NS+ND=C--; to --$N_S$+$N_D$=C--;

UNITED STATES PATENT AND TRADEMARK OFFICE

CERTIFICATE OF CORRECTION

PATENT NO. : 4,975,741

DATED : December 04, 1990

INVENTOR(S) : Masaaki Tanaka

It is certified that error appears in the above-identified patent and that said Letters Patent is hereby corrected as shown below:

Column 20, Line 30, after "start" insert --initiation--;

Column 20, Line 42, after "time" change "," to --.--;

Column 20, Line 60, after "thereby" delete [to];

Column 21, Line 37, change "Misgripping" to --misgripping--;

Column 21, Line 44, after "providing" insert --a--;

Column 22, Line 3, after "example" insert --,--;

Column 22, Line 4, change "(b)" to --12(b)--;

Column 22, Line 18, after "encoder" insert --,--;

UNITED STATES PATENT AND TRADEMARK OFFICE

CERTIFICATE OF CORRECTION

PATENT NO. : 4,975,741

DATED : December 04, 1990

INVENTOR(S) : Masaaki Tanaka

It is certified that error appears in the above-identified patent and that said Letters Patent is hereby corrected as shown below:

Column 22, Line 28, change "Nd" to --$N_D$--;

Column 25, Line 3, after "under" delete [,];

Column 25, Line 28, after "be" insert --,--;

Column 25, Line 33, before "movable" delete [optical system];

Column 25, Line 43, change "compared" to --compares--;

Column 25, Line 45, after "mm" insert --.--;

Column 25, Line 46, change "different" to --difference--;

Column 25, Line 51, change "permits," to --prevents--;

Column 25, Lines 65 & 66, after "embodiment" insert --,--;

UNITED STATES PATENT AND TRADEMARK OFFICE

CERTIFICATE OF CORRECTION

PATENT NO. : 4,975,741

DATED : December 04, 1990

INVENTOR(S) : Masaaki Tanaka

It is certified that error appears in the above-identified patent and that said Letters Patent is hereby corrected as shown below:

Column 26, Line 33, change "effecting" to --affecting--;

Column 26, Line 62, change "Besides, with" to --Furthermore, in--;

Claim 3, Column 30, Line 53, change "fruit" to --first--;

Claim 3, Column 30, Line 54, change "detecting" to --detection--;

Drawings, Fig. 5A, at "309" change "PMW" to --PWM--.

Signed and Sealed this

First Day of December, 1992

*Attest:*

*Attesting Officer*

DOUGLAS B. COMER

*Acting Commissioner of Patents and Trademarks*